US010722853B2

(12) United States Patent
Pappalardo

(10) Patent No.: US 10,722,853 B2
(45) Date of Patent: Jul. 28, 2020

(54) STATIC MIXER WITHOUT MIXING BAFFLE SIDEWALLS AND ASSOCIATED MIXING CONDUIT

(71) Applicant: NORDSON CORPORATION, Westlake, OH (US)

(72) Inventor: Matthew E. Pappalardo, Ewing, NJ (US)

(73) Assignee: Nordson Corporation, Westlake, OH (US)

( * ) Notice: Subject to any disclaimer, the term of this patent is extended or adjusted under 35 U.S.C. 154(b) by 272 days.

(21) Appl. No.: 16/027,357

(22) Filed: Jul. 4, 2018

(65) Prior Publication Data

US 2019/0039032 A1 Feb. 7, 2019

Related U.S. Application Data

(60) Provisional application No. 62/541,574, filed on Aug. 4, 2017.

(51) Int. Cl.

| | |
|---|---|
| ***B01F 5/00*** | (2006.01) |
| ***B01F 5/06*** | (2006.01) |
| ***B01F 3/10*** | (2006.01) |

(52) U.S. Cl.

CPC ..... *B01F 5/064* (2013.01); *B01F 3/10* (2013.01); *B01F 5/0606* (2013.01); *B01F 5/0619* (2013.01); *B01F 5/0641* (2013.01); *B01F 2005/0621* (2013.01); *B01F 2005/0635* (2013.01)

(58) Field of Classification Search

CPC ..... B01F 5/064; B01F 3/10; B01F 5/0606; B01F 5/0619; B01F 5/0641; B01F 2005/0621; B01F 2005/0635

See application file for complete search history.

(56) References Cited

U.S. PATENT DOCUMENTS 3,593,964 A 7/1971 Morane
4,801,008 A * 1/1989 Rich ..... B05C 17/00516 206/219
5,851,067 A 12/1998 Fleischli et al.
(Continued)

FOREIGN PATENT DOCUMENTS

CH 699958 A1 5/2010
DE 3208462 A1 9/1983
(Continued)

OTHER PUBLICATIONS

DE 32 08 462 A1 to Hiliti Original Document with Drawings Published Sep. 15, 1983 (Year: 1983).*
(Continued)

*Primary Examiner* — Anshu Bhatia
(74) *Attorney, Agent, or Firm* — Baker & Hostetler LLP

(57) ABSTRACT

A static mixer for mixing a flow of two or more fluids is disclosed. The static mixer includes a mixing conduit that defines a mixing passage, and a mixing element configured to be received by the mixing passage that includes at least two mixing baffles. Each of the at least two mixing baffles comprises a plurality panels that are configured to divide and mix the fluid as the fluid flows through the mixing passage. No continuous sidewalls extend between the at least two mixing baffles, and the mixing element is tapered along a longitudinal direction.

31 Claims, 26 Drawing Sheets

(56) References Cited

U.S. PATENT DOCUMENTS

| | | | | |
|---|---|---|---|---|
| 5,944,419 | A * | 8/1999 | Streiff | B01F 5/0641 366/337 |
| 6,585,407 | B2 | 7/2003 | Koch | |
| 7,841,765 | B2 | 11/2010 | Keller | |
| 8,936,391 | B2 | 1/2015 | Stoeckli et al. | |
| 10,040,039 | B2 | 4/2018 | Huang | |
| 2005/0047274 | A1* | 3/2005 | Moser | B01F 5/0619 366/336 |
| 2017/0036179 | A1 | 2/2017 | Pappalardo et al. | |
| 2017/0266631 | A1* | 9/2017 | Smith | B01F 5/0463 |

FOREIGN PATENT DOCUMENTS

| | | | |
|---|---|---|---|
| DE | 112014000256 | T5 | 4/2016 |
| DE | 202015105397 | U1 | 1/2017 |
| EP | 0749776 | A1 | 12/1996 |
| EP | 0815929 | A1 | 1/1998 |
| EP | 1149626 | A1 | 10/2001 |
| EP | 1426099 | A1 | 6/2004 |

OTHER PUBLICATIONS

European search report dated Jan. 18, 2019 for EP Application No. 18187379.
European search report dated Apr. 26, 2019 for EP Application No. 18187379.

* cited by examiner

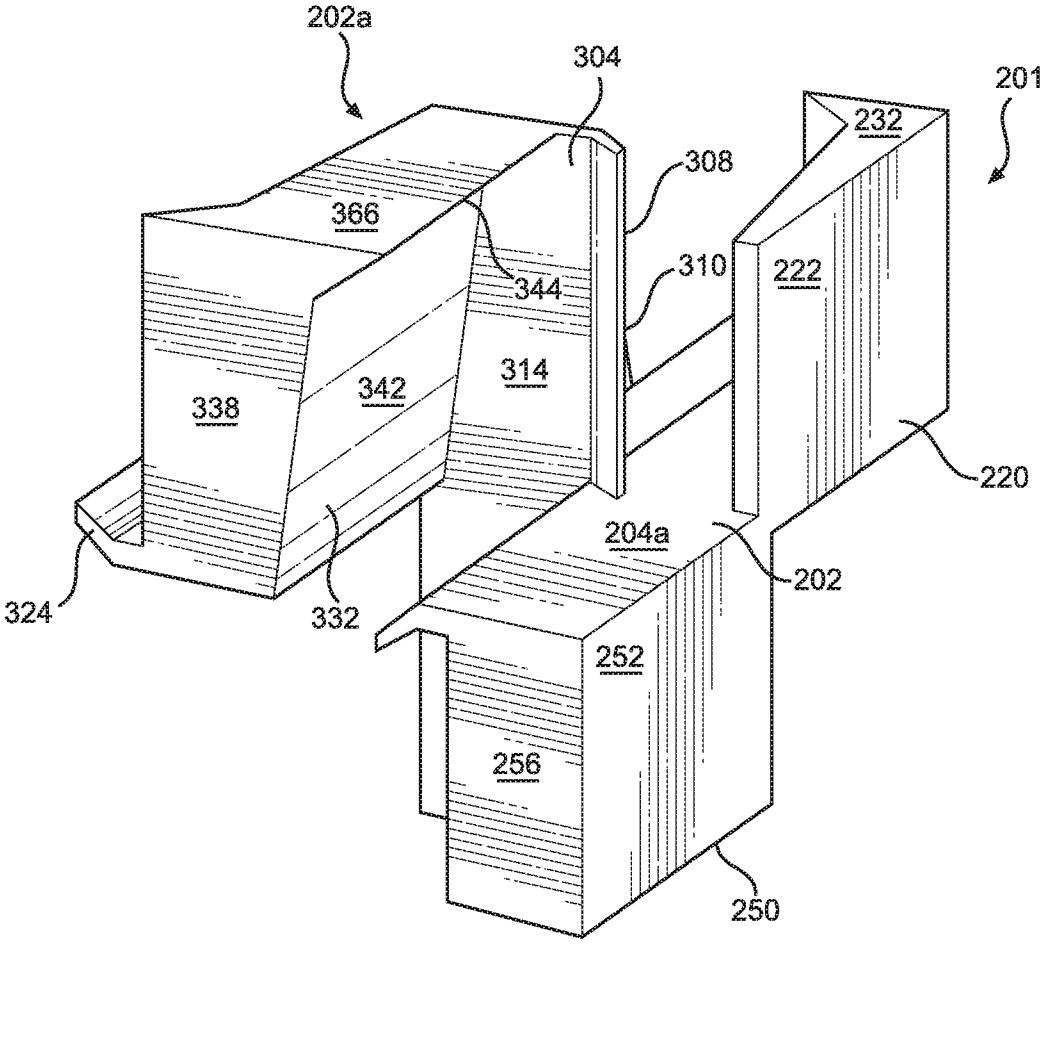
FIG. 11C
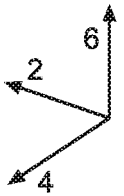

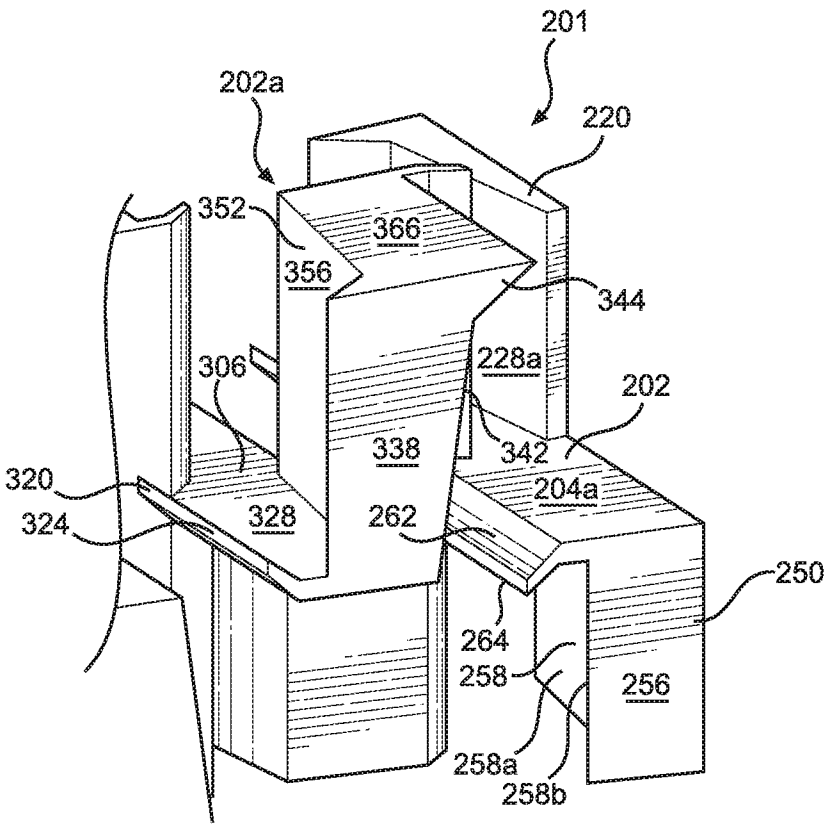
FIG. 11D
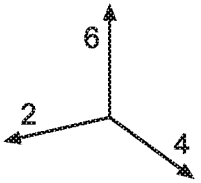

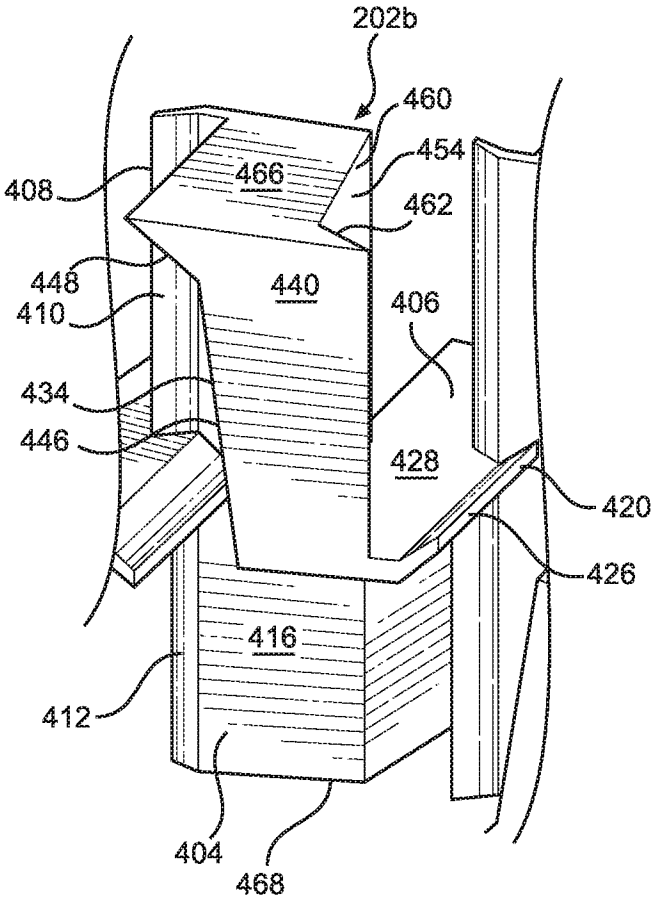
FIG. 12A
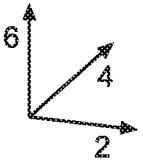

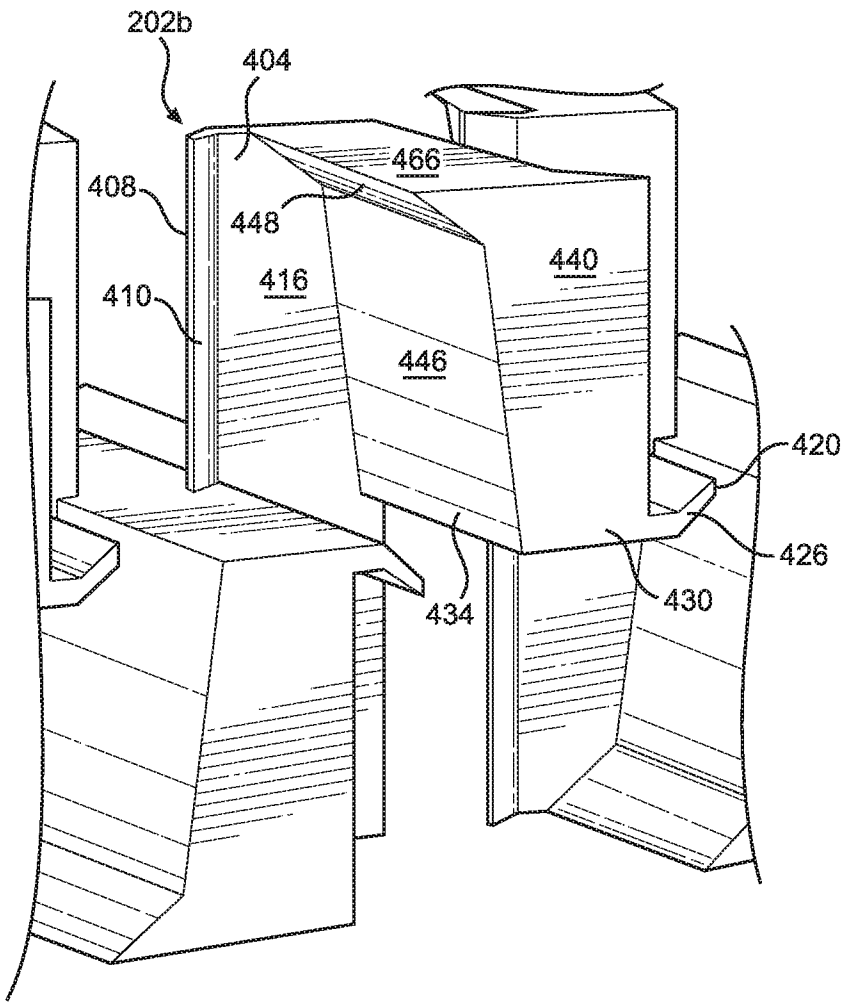
FIG. 12B
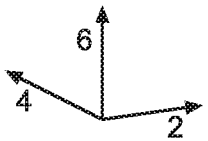

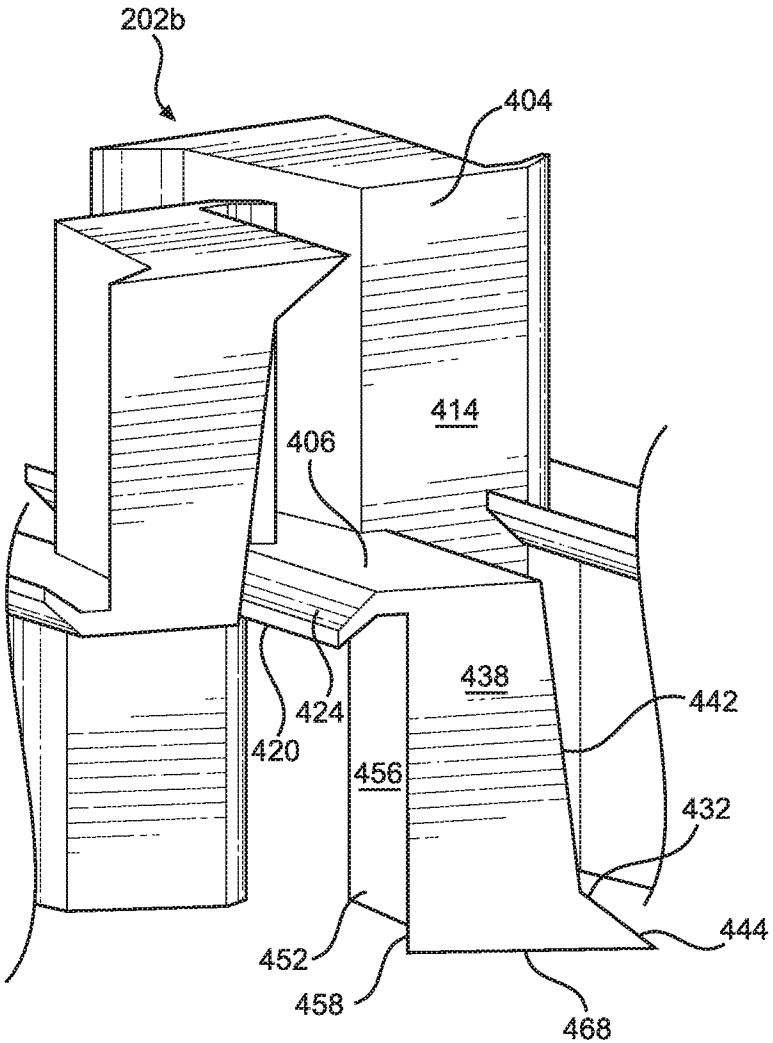
FIG. 12D
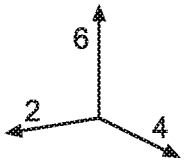

STATIC MIXER WITHOUT MIXING BAFFLE SIDEWALLS AND ASSOCIATED MIXING CONDUIT

CROSS REFERENCE TO RELATED APPLICATIONS

This application claims the benefit of U.S. Provisional Patent App. No. 62/541,574, filed Aug. 4, 2017, the disclosure of which is hereby incorporated by reference herein.

TECHNICAL FIELD

This disclosure generally relates to static mixers used for the mixing of two or more fluids, as well as related static mixer components.

BACKGROUND

Known static mixers include a mixing conduit that defines a passage and a mixing element comprised of a series of mixing baffles disposed within the passage. When two or more fluids are pumped into the static mixer, the flow of fluid along and around the non-moving mixing baffles continuously blends the fluids. The flow of fluids eventually forms a relatively homogenous mixture upon exiting the static mixer. This method of mixing is very effective for viscous materials in particular, such as epoxies, acrylics, and polyurethanes.

Many variations of static mixers currently exist, including multiflux, helical, and x-lattice mixers, amongst others. In particular, mixing elements utilizing multiflux and helical designs are commonly formed from plastic and are disposable, as these designs can be injection molded to form a unitary multi-element structure. Multiflux mixing elements can statically mix two or more materials in a shorter length, with less retained waste, and with less back pressure than comparable helical mixers.

Currently, injection molded multiflux mixing elements are comprised of multiple mixing baffles connected by two or more sidewalls. The mixing baffles are generally comprised of one or more dividing panels for dividing the fluid flow, multiple deflecting panels positioned to move fluid in a direction offset from the direction of fluid flow, and one or more mixing panels for recombining the fluid flow. The sidewalls present in these mixing baffles provide structure and strength to the linked mixing baffles, thus allowing the mixing baffles to withstand elevated fluid pressures.

As fluid pressures within the static mixer increase, forces likewise increase on the mixing baffles within the passage. As a result, the mixing baffle at a position most downstream within the passage generally bears the total accumulated force exerted on the entire mixing element. Because of this, the most downstream element is the region of the static mixer most likely to fail during a mixing operation. To help prevent this, disposable multiflux mixing elements generally include sidewalls connecting the baffles to provide stability and additional support by transmitting forces from each individual baffle to the bearing surfaces of the mixer housing.

However, sidewalls present certain issues. For example, fluid trapped between a sidewall and an inner surface of the mixing conduit can exit the static mixer as unmixed streaks. Additionally, sidewalls can reduce the flow rate of fluid within a static mixer, thus impeding the mixing process. Further, the presence of sidewalls causes the static mixer to require a larger mixing conduit, thus requiring additional material to mold, which subsequently creates additional waste. Sidewalls also prevent certain baffle geometries and sizes from being molded with an injection molding process. Sidewalls function to block injection mold tooling from being able to access and core out certain desirable features and geometries. Further, sidewalls prevent small multiflux mixers from being manufactured. While helical mixing elements can be molded to have a diameter as low as 1.3 mm (0.050"), the smallest disposable multiflux mixers have a diameter that is almost four times larger. The walls of current multiflux mixing elements would occupy such a large portion of a static mixer's cross section at sizes smaller than 0.20"×0.20" that the resulting multiflux mixer would be rendered ineffective. Additionally, any protruding teeth or ledges in the cavities of the multiflux mixing element would be too thin and fragile to withstand a fluid flow under pressure.

Therefore, there is a need for a static miser with a mixing element that does not require sidewalls.

SUMMARY

An embodiment of the present disclosure includes a static mixer for mixing a fluid flow having at least two components. The static mixer includes a mixing conduit defining a mixing passage configured to receive the fluid flow and a mixing element received in the mixing passage and including at least two mixing baffles aligned along a longitudinal direction, where no continuous sidewalls extend between the at least two mixing baffles. Each of the at least two mixing baffles includes a first dividing panel defining a top side, a bottom side opposite the top side along a transverse direction that is perpendicular to the longitudinal direction, a first side, and a second side opposite the first side along a lateral direction that is perpendicular to the transverse and longitudinal directions. The first dividing panel also defines a first width measured from the first side to the second side along the lateral direction at a first location, and a second width measured from the first side to the second side along the lateral direction at a second location that is spaced from the first location along the longitudinal direction, where the first width is greater than the second width. Each of the at least two mixing baffles also includes a first deflecting panel extending from the top side of the first dividing panel and a second dividing panel spaced from the first dividing panel along the transverse direction. The second dividing panel defines a top side and a bottom side opposite the top side along the transverse direction, where the top side of the second dividing panel faces the bottom side of the first dividing panel. Additionally, each of the at least two mixing baffles includes a second deflecting panel extending from the bottom side of the second dividing panel and a third deflecting panel that extends from the bottom side of the first dividing panel to the top side of the second dividing panel. Further, each of the at least two mixing baffles includes a first mixing panel extending from the first and second dividing panels along the longitudinal direction and a second mixing panel extending from the first and second dividing panels along the longitudinal direction. Additionally, the fluid flow is divided into three flow portions by the first and second dividing panels and the first, second, and third deflecting panels of each of the at least two mixing baffles, and the three flow portions are combined into a mixture upon flowing past the first and second mixing panels of each of the at least two mixing baffles.

Another embodiment of the present disclosure is a static mixer for mixing a fluid flow having at least two components. The static mixer includes a mixing conduit defining a mixing passage configured to receive the fluid flow and a mixing element received in the mixing passage and including at least two mixing baffles aligned along a longitudinal direction, where no continuous sidewalls extend between the at least two mixing baffles. Each of the at least two mixing baffles includes a dividing panel including a first surface and a second surface opposite the first surface along a lateral direction that is perpendicular to the longitudinal direction, and a mixing panel connected to the dividing panel and oriented transverse to the dividing panel. The mixing panel includes a top side and a bottom side opposite the top side along a transverse direction that is perpendicular to the lateral and longitudinal directions. Each of the at least two mixing baffles also includes a first deflecting panel extending from the first surface of the dividing panel, and a second deflecting panel extending from the second surface of the dividing panel. Each of the at least two mixing baffles defines a first width measured at a first location along the lateral direction that extends from a first side that extends from the mixing panel along the transverse direction to a second side that extends from the mixing panel along the transverse direction. Each of the at least two mixing baffles further defines a second width measured from the first side to the second side along the lateral direction at a second location that is spaced from the first location along the longitudinal direction, where the first width is greater than the second width. Additionally, the fluid flow is divided into two flow portions by the dividing panel and the first and second deflecting panels of each of the at least two mixing baffles, and the two flow portions are combined into a mixture upon flowing past the mixing panel of each of the at least two mixing baffles.

A further embodiment of the present disclosure is a static mixer for mixing a fluid flow having at least two components. The static mixer includes a mixing conduit defining an inner surface and a mixing passage defined by the inner surface that is configured to receive the fluid flow, and a mixing element that is tapered along a longitudinal direction and is received in the mixing passage. The mixing element includes at least two mixing baffles aligned along the longitudinal direction, where no continuous sidewalls extend between the at least two mixing baffles. Each of the at least two mixing baffles includes at least one dividing panel and at least two deflecting panels extending from the at least one dividing panel, where the at least two deflecting panels and the at least one dividing panel are configured to divide the flow into at least two flow portions. Each of the at least two mixing baffles also includes at least one mixing panel connected to the at least one dividing panel, where the at least two flow portions are combined into a mixture upon flowing past the at least one mixing panel. Additionally, the mixing element is configured to bias against the inner surface of the mixing conduit such that force imposed on the mixing element by the fluid flow is transferred from the mixing element to the mixing conduit.

BRIEF DESCRIPTION OF THE DRAWINGS

The foregoing summary, as well as the following detailed description, will be better understood when read in conjunction with the appended drawings. The drawings show illustrative embodiments of the invention. It should be understood, however, that the application is not limited to the precise arrangements and instrumentalities shown.

FIG. 11C is a left front perspective view of the leading element and left mixing baffle shown in FIG. 9;

FIG. 11D is a left rear perspective view of the leading element and left mixing baffle shown in FIG. 9;

FIG. 12A is a right rear perspective view of a right mixing baffle shown in FIG. 9;

FIG. 12B is a right front perspective view of the right mixing baffle shown in FIG. 9:

FIG. 12D is a left rear perspective view of the right mixing baffle shown in FIG. 9.

DETAILED DESCRIPTION OF ILLUSTRATIVE EMBODIMENTS

Figure 1:
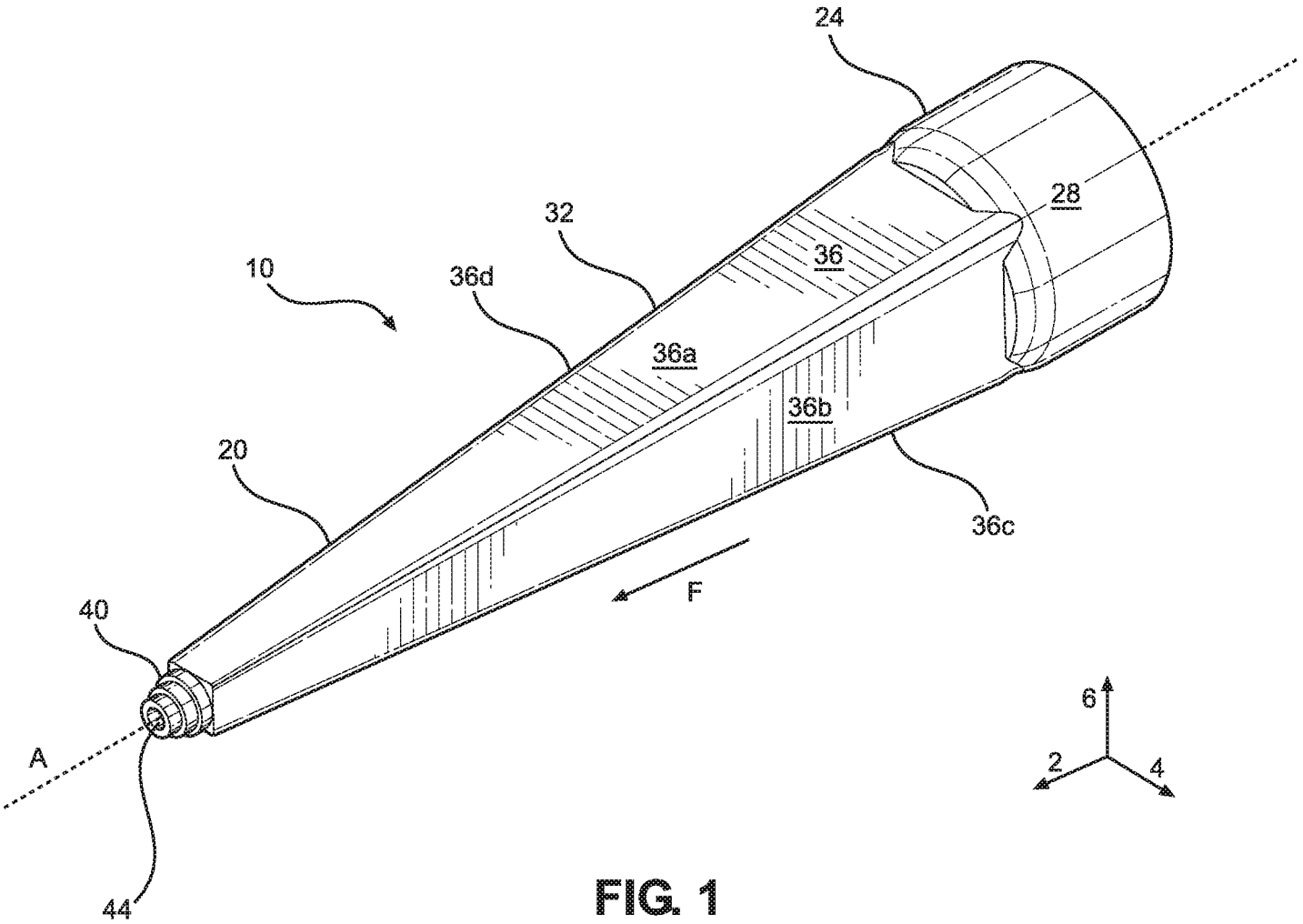
FIG. 1 is a perspective view of a static mixer according to an embodiment of the application.

A static mixer 10 is disclosed that includes a mixing conduit 20 that defines a mixing passage 48. The mixing passage 48 is configured to receive a mixing element, such as the mixing element 100 or mixing element 200, where the mixing elements 100 and 200 are configured to mix two or more fluids flowing within the mixing passage 48.

Certain terminology is used to describe the static mixer 10 in the following description for convenience only and is not limiting. The words "right," "left," "lower," and "upper" designate directions in the drawings to which reference is made. The words "inner" and "outer" refer to directions toward and away from, respectively, the geometric center of the description to describe the static mixer 10 and related parts thereof. The words "forward" and "rearward" refer to directions in a longitudinal direction 2 and a direction opposite the longitudinal direction 2 along the static mixer 10 and related parts thereof. The terminology includes the above-listed words, derivatives thereof, and words of similar import.

Unless otherwise specified herein, the terms "longitudinal," "lateral," and "transverse" are used to describe the orthogonal directional components of various components of the static mixer 10, as designated by the longitudinal direction 2, lateral direction 4, and transverse direction 6. It should be appreciated that while the longitudinal and lateral directions 2 and 4 are illustrated as extending along a horizontal plane, and the transverse direction 6 is illustrated as extending along a vertical plane, the planes that encompass the various directions may differ during use.

Figure 2:
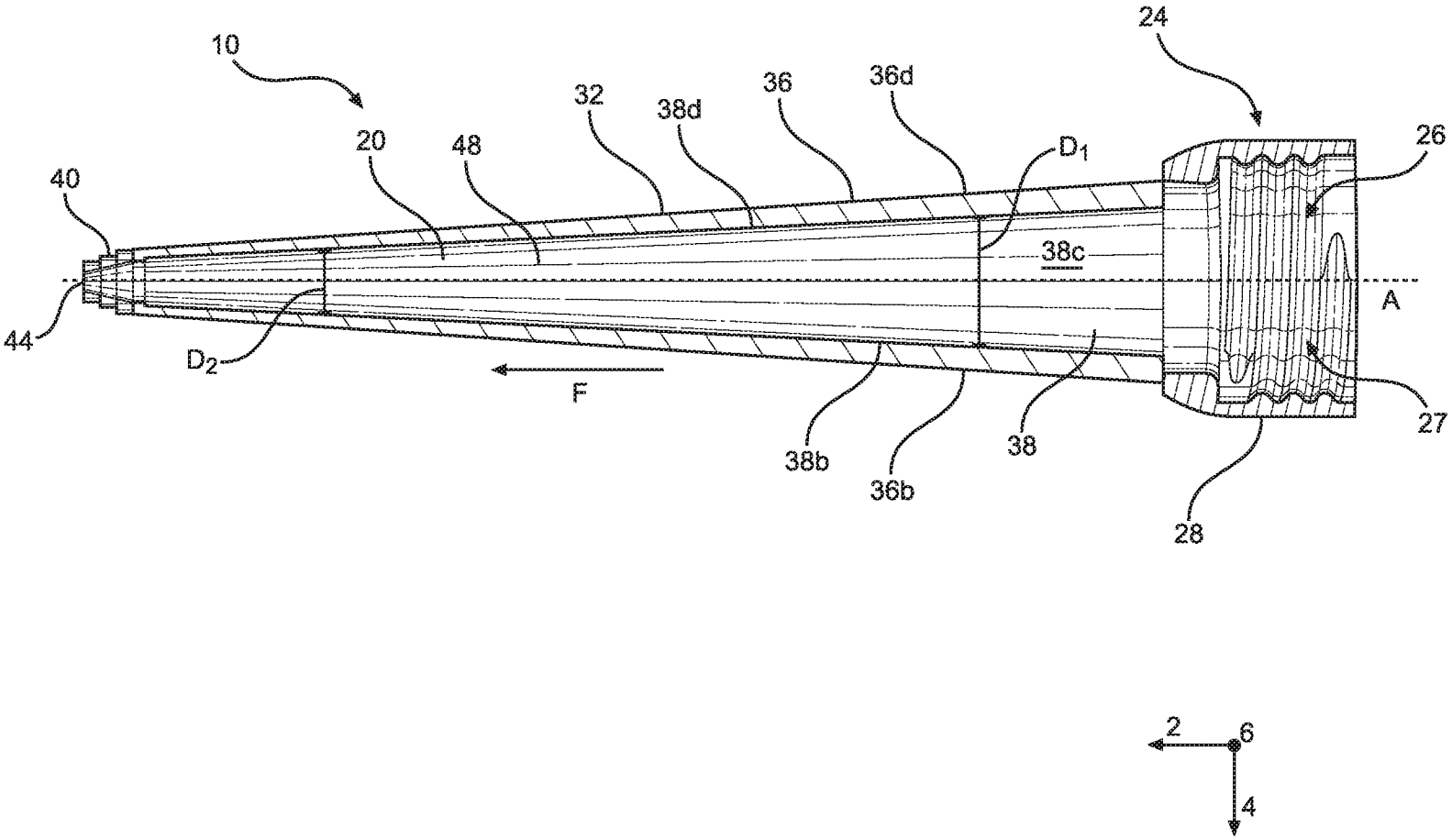
FIG. 2 is a lateral cross-sectional view of a mixing conduit according to an embodiment of the application.
Figure 3:
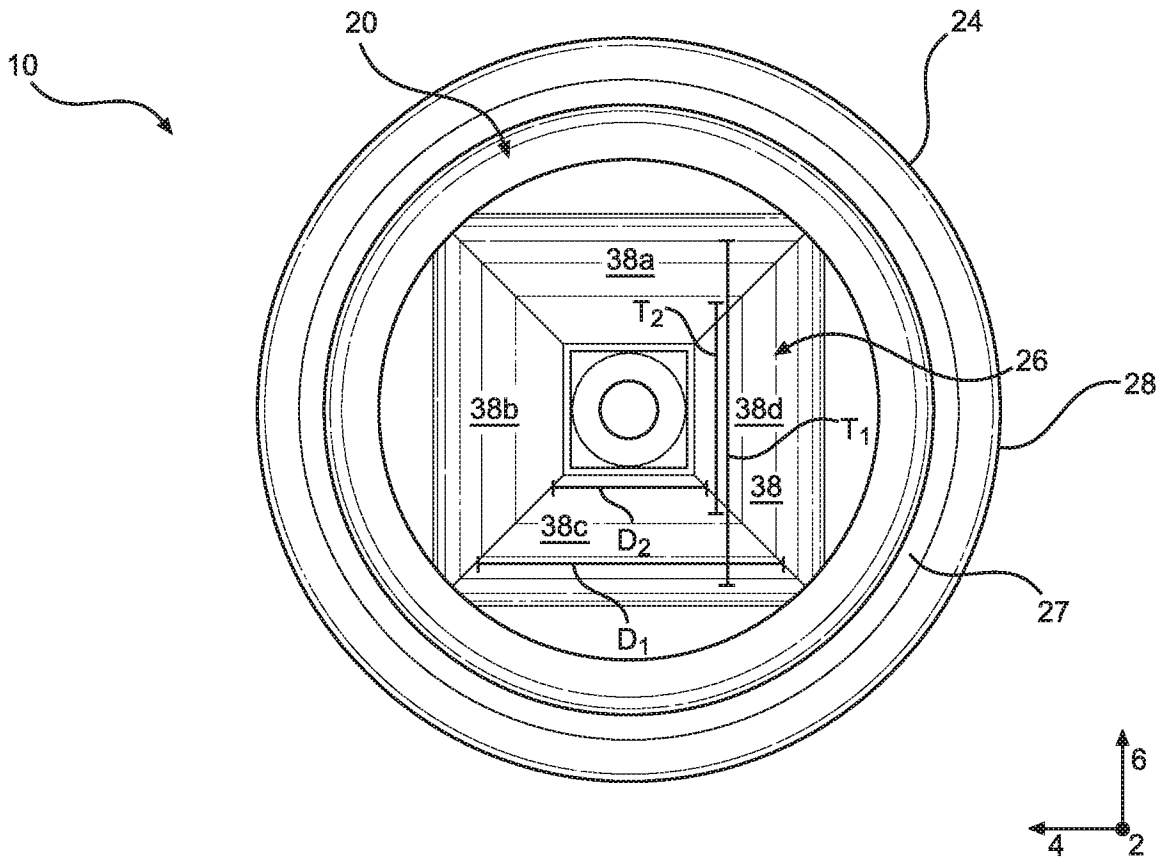
FIG. 3 is a rear view of the mixing conduit shown in FIG. 2.

Embodiments of the present application include a static mixer 10 for mixing two or more fluid flows into a homogenous fluid mixture. Referring to FIGS. 1-3, the static mixer 10 includes a mixing conduit 20 that is configured to receive a mixing element, such as mixing elements 100 or 200, which will be described further below. The mixing conduit 20 defines a socket 24, a nozzle 40, and a body section 32 that extends from the socket 24 to the nozzle 40 along a central axis A, which is substantially parallel to the longitudinal direction 2. The socket 24 may be substantially circular, and defines an outer surface 28. The body section 32 also defines an outer surface 36, but may be have a substantially square or rectangular shape that tapers as the body section 32 extends from the socket 24 to the nozzle 40. The outer surface 36 of the body section 34 includes a top surface 36*a*, a bottom surface 36*c* opposite the top surface 36*a* along the transverse direction 6, a first side surface 36*b*, and a second side surface 36*d* opposite the first side surface 36*b* along the lateral direction 4. Each of the top surface 36*a*, bottom surface 36*c*, first side surface 36*b*, and second side surface 36*d* may be substantially planar. The intersections between the top surface 36*a*, bottom surface 36*c*, first side surface 36*b*, and second side surface 36*d* may be curved or beveled, as shown in FIG. 1, or may define right angles. The nozzle 40 extends from the end of the body section 32, and defines an outlet 44, through which homogenous mixed fluid exits the static mixer 10.

Continuing with FIGS. 2 and 3, the body section 32 defines an inner surface 38, which defines a mixing passage 48 that extends from a socket opening 26 defined by the socket 24 to the outlet 44 defined by the nozzle 40. The socket 24 also defines threading 27, which is capable of allowing the mixing conduit 20 to be releasably and securely coupled to a fluid storage or pumping mechanism (not shown). In operation, a mixing element, such as mixing elements 100 or 200, are configured to be received by the mixing passage 48, along with a flow of two or more fluids to be mixed. The inner surface 38 includes a top inner surface 38*a*, a bottom inner surface 38*c* opposite the top inner surface 38*a* along the transverse direction 6, a first inner surface 38*b*, and a second inner surface 38*d* opposite the first inner surface 38*b* along the lateral direction 4. Like the outer surface 28, the intersections of the top inner surface 38*a*, the bottom inner surface 38*c*, the first inner surface 38*b*, and the second inner surface 38*d* may be tapered or curved. Alternatively, these intersections can substantially form right angles.

The mixing passage 48 tapers as it extends from the socket opening 26 to the outlet 44, such that the cross sectional area of the mixing passage 48 decreases as the mixing passage 48 extends away from the socket opening 26 and toward the outlet 44. As such, the mixing passage 48 defines a first width $D_1$ that is measured from the first inner surface 38*b* to the second inner surface 38*d* along the lateral direction 4 at a first position, as well as a second width $D_2$ that is measured from the first inner surface 38*b* to the second inner surface 38*d* along the lateral direction 4 at a second position that is spaced from the first position in the longitudinal direction 2. Because of the taper of the mixing passage 48, the first width $D_1$ is greater than the second width $D_2$. The mixing passage 48 also defines a first height $T_1$ measured from the top inner surface 38*a* to the bottom inner surface 38*c* along the transverse direction 6 at a first position, as well as a second height $T_2$ measured from the top inner surface 38*a* to the bottom inner surface 38*c* along the transverse direction 6 at a second position that is spaced from the first position in the longitudinal direction 2. Like the first and second widths $D_1$ and $D_2$, the taper of the mixing passage 48 causes the first height $T_1$ to be greater than the second height $T_2$.

Figure 4:
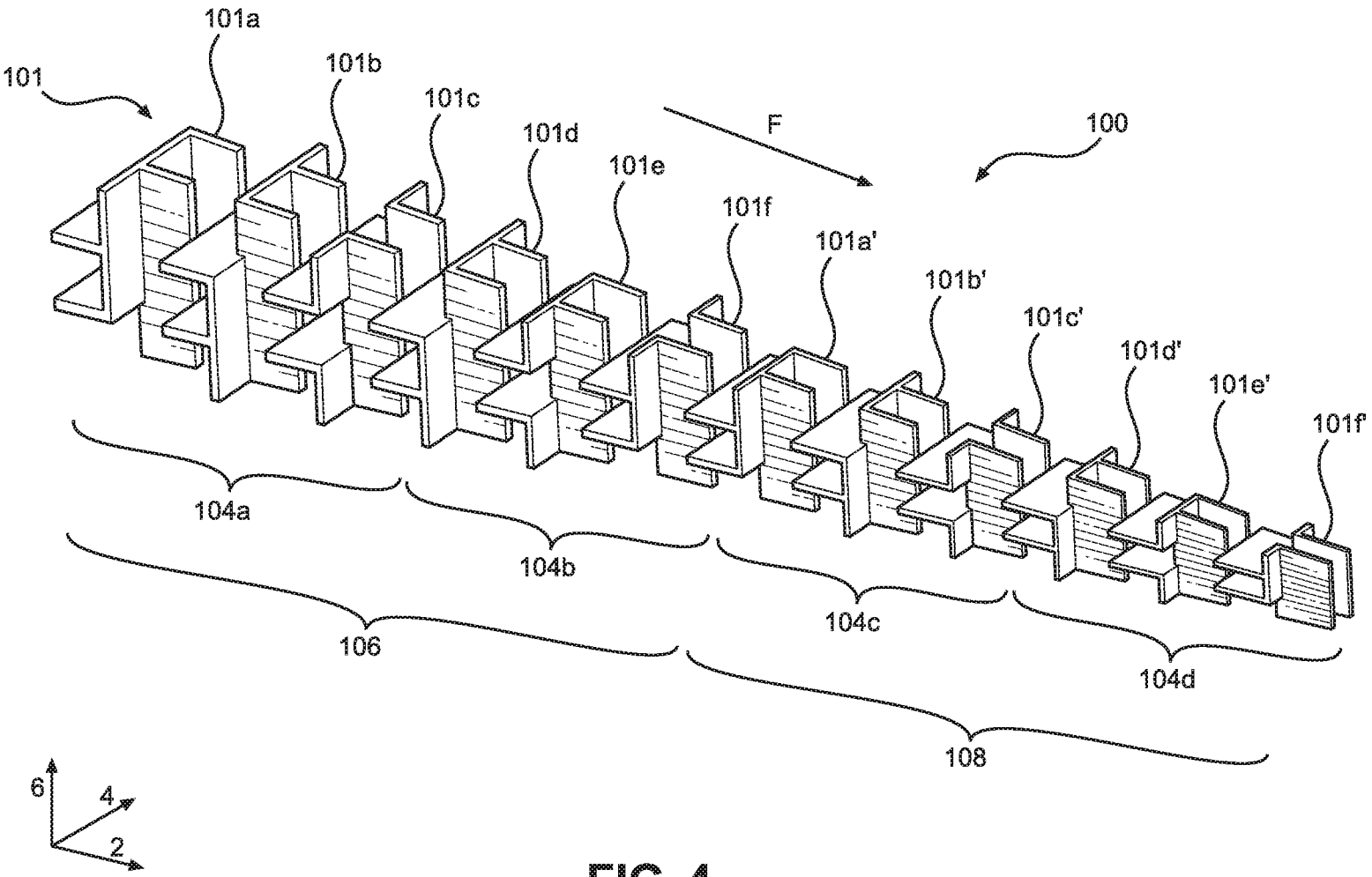
FIG. 4 is a perspective view of a mixing element according to one embodiment of the application.
Figure 5A:
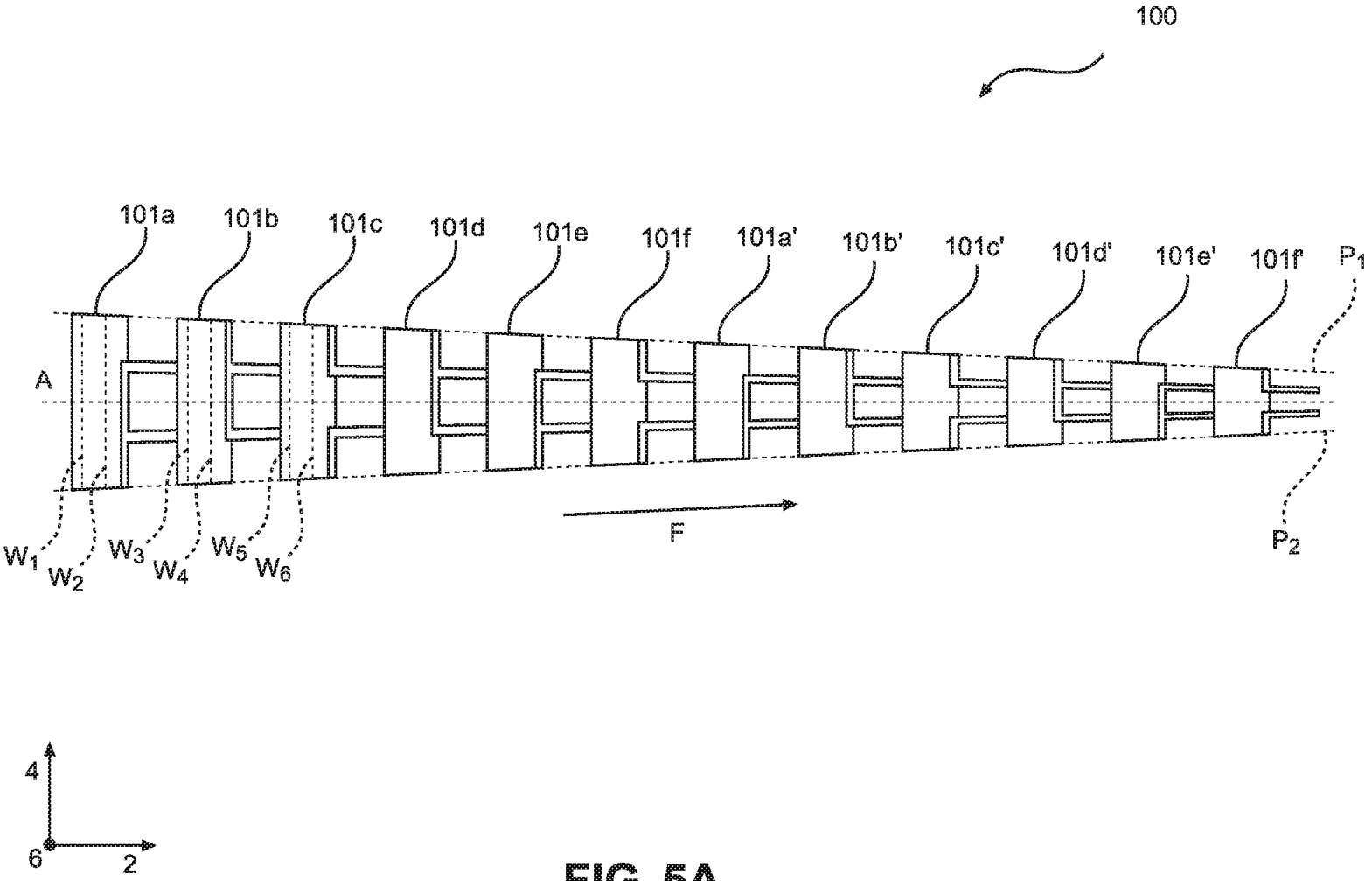
FIG. 5A is a top view of the mixing element shown in FIG. 4.

Now referring to FIGS. 4-5C, a mixing element 100 according to one embodiment of the present application will be described. The mixing element 100 is comprised of a plurality of integrally connected mixing baffles 101, such that the mixing element 100 forms a monolithic unit. In particular, the mixing element 100 includes alternating arrangements of first mixing baffles 101*a*, second mixing baffles 101*b*, and third mixing baffles 101*c*, as well as mirror images thereof, which are designated as fourth mixing baffles 101*d*, fifth mixing baffles 101*e*, and sixth mixing baffles 101*f*, respectively. The fourth through sixth mixing baffles 101*d*-101*f* are mirror images of the first through third mixing baffles 101*a*-101*c* about a central plane A (shown in FIG. 5A) that extends in the longitudinal and transverse directions 2 and 6. The mixing element 100 may also include additional mixing baffles of decreased dimensions that are structurally identical to mixing baffles 101*a*-101*f*, which are designated as mixing baffles 101*a*'-101*f*', respectively.

More generally, certain ones of the mixing baffles 101 of the mixing element 100 may be grouped into separate elements. As shown in FIG. 4, first, second, and third mixing baffles 101*a*-101*c* may define a first element 104*a*, while the fourth, fifth, and sixth mixing baffles 101*d*-101*f* may define a second element 104*b*, where the first and second elements 104*a* and 104*b* are mirror images of each other. Further, alternatively sized first, second, and third mixing baffles 101*a*'-101*c*' may define a third element 104*c*, while the alternatively sized fourth, fifth, and sixth mixing baffles 101*d*'-101*f*' may define a fourth element 104*d*, where the third and fourth elements 104*c* and 104*d* are mirror images of each other. The first and second elements 104*a* and 104*b* may collectively define a first segment 106, while the third and fourth elements 104*c* and 104*d* may collectively define a second segment 108, where the first and second segments 106 and 108 are mirror images of each other. Together, the first and second segments 106 and 108 may define the mixing element 100. However, only one embodiment of the mixing element 100 is shown, and the mixing element 100 may be alternatively configured with different arrangements of the first through sixth mixing baffles 101*a*-101*f* as desired, as well as different arrangements of the first through sixth mixing baffles 101*a*'-101*f*'.

The mixing element 100 is configured such that two or more fluids are mixed as they flow through the mixing element 100, which is configured to be disposed in the mixing passage 48 of a mixing conduit. As shown in FIG. 4, the fluid flow extends substantially along the longitudinal direction 2, from the first mixing baffle 101*a* to the sixth mixing baffle 101*f*'. Each of the mixing baffles 101 divides the fluid flow through the mixing passage 48 at a leading edge of the mixing baffles 101, and then shifts the fluid flow before recombining the fluid flow at a trailing edge of the mixing baffles 101. In particular, the mixing baffles 101 generally divide the fluid flow into three flow paths through each of the mixing baffles 101 before recombining the fluid flow. The mixing baffles 101 maybe integrally molded, such that the mixing element 100 defines a monolithic structure. Further, the mixing element 100 is formed without the use of continuous sidewalls.

Figure 5B:
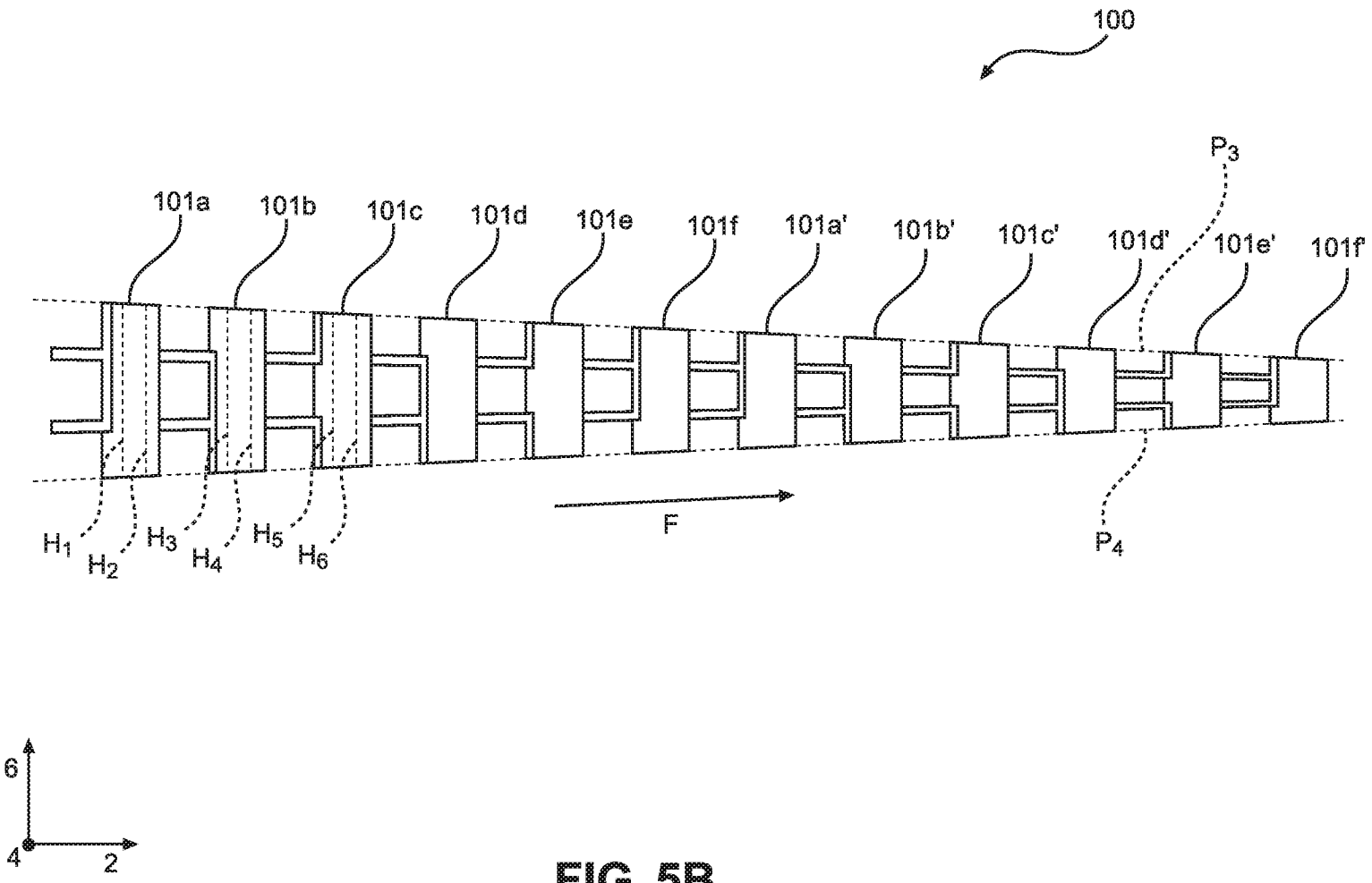
FIG. 5B is a side view of the mixing element shown in FIG. 4.

The mixing element 100 can define a tapered profile, such that it narrows as it extends along the longitudinal direction 2. As shown in FIGS. 5A and 5B, the mixing element 100 can consistently narrow in cross-section between the first mixing baffle 101*a* and the sixth mixing baffle 101*f*'. With respect to the width of the mixing element 100, the sides of the mixing element 100 can be contained within respective planes $P_1$ and $P_2$ that are angled towards each other with respect to the lateral direction 4 as the planes $P_1$ and $P_2$ extend in the longitudinal direction 2. As a result, each mixing baffle 101 is narrower than the preceding mixing baffle 101 in the mixing element 100 (for example, second mixing baffle 101*b* is less narrower first mixing baffle 101*a*, and second mixing baffle 101*b*' is less narrower second mixing baffle 101*b*). While the mixing element 100 is tapered such that each mixing baffle 101 is narrower than the preceding mixing baffle, the mixing baffles 101 themselves can also be uniformly tapered, such that the mixing baffles 101 each individually narrow as they extend along the longitudinal direction 2. As shown in FIG. 5A, for example, the first mixing baffle 101*a* defines a first width $W_1$ at a first location, and a second width $W_2$ at a second location spaced from the first location along the longitudinal direction 2, such that the first width $W_1$ is greater than the second width $W_2$. Similarly, the second mixing baffle 101*b* defines a first width $W_3$ at a first location, and a second width $W_4$ at a second location spaced from the first location along the longitudinal direction 2, such that the first width $W_3$ of the second mixing baffle 101*b* is greater than the second width $W_4$. Additionally, the third mixing baffle 101*c* defines a first width $W_5$ at a first location, and a second width $W_6$ at a second location spaced from the first location along the longitudinal direction 2, such that the first width $W_5$ is greater than the second width $W_6$. Though widths with respect to the first, second, and third mixing baffles 101*a*-101*c* are discussed here specifically, this is done for exemplary purposes, and each of the mixing baffles 101*a*-101*f* and 101*a*'-101*f*' can be similarly situated. In one embodiment, each of the first and second widths of the first, second, and third mixing baffles $W_1$-$W_6$ is less than 0.20 inches.

With respect to the height of the mixing element 100, the top and bottom of the mixing element 100 can be contained within respective planes $P_3$ and $P_4$ that are angled towards each other with respect to the transverse direction 6 as the planes $P_3$ and $P_4$ extend in the longitudinal direction 2. As a result, each mixing baffle 101 is shorter than the preceding mixing baffle 101 in the mixing element 100 (for example, second mixing baffle 101*b* is shorter than first mixing baffle 101*a*, and second mixing baffle 101*b*' is shorter than second mixing baffle 101*b*). While the mixing element 100 is tapered such that each mixing baffle 101 is shorter than the proceeding mixing baffle 101, the mixing baffles 101 themselves can be uniformly tapered, such that the mixing baffles 101 each shorten as they extend along the longitudinal direction 2. As shown in FIG. 5B, for example, the first mixing baffle 101*a* defines a first height $H_1$ at a first location, and a second height $H_2$ at a second location spaced from the first location along the longitudinal direction, such that the first height $H_1$ is greater than the second height $H_2$. Similarly, the second mixing baffle 101*b* defines a first height $H_3$ at a first location, and a second height $H_4$ at a second location spaced from the first location along the longitudinal direction 2, such that the first height $H_3$ is greater than the second height $H_4$. Additionally, the third mixing baffle 101*c* defines a first height $H_5$ at a first location, and a second height $H_6$ at a second location spaced from the first location along the longitudinal direction 2, such that the first height $H_5$ is greater than the second height $H_6$. Though heights are described here with respect to first, second, and third mixing baffles 101*a*, 101*b*, and 101*c* specifically, this is done for exemplary purposes, and each of the mixing baffles 101*a*-101*f* and 101*a*'-101*f*' can be similarly situated. In one embodiment, the first and second heights of the first, second, and third mixing baffles $H_1$-$H_6$ are each less than 0.20 inches.

The tapered heights and widths of the mixing element 100, coupled with the tapered inner surface 38 of the mixing conduit 20, provide several benefits. As fluid pressure within a static mixer increases, the pressure elements of the static mixer increase in the downstream direction. By tapering the heights and widths of the mixing element 100 in the longitudinal direction 2, the top, bottom, and sides of the mixing element 100 directly contact the inner surface 38 of the mixing conduit 20, thus allowing the mixing element 100 to effectively act as a wedge within the mixing passage 48. As such, forces acting on the mixing element 100 from the flow of fluid are evenly distributed throughout the mixing element 100 and transferred to the mixing conduit 20. This allows the mixing element 100 to be formed without continuous sidewalls. The lack of continuous sidewalls provides several advantages. Due to the lack of continuous sidewalls, the mixing element 100 can be formed through injection molding with more complex geometries (as will be described below), can be produced with shorter lengths, and can be scaled down to overall smaller sizes. The removal of sidewalls further reduces an impediment to fluid flow within the mixing passage 48, and allows the mixing conduit 20 to be smaller. Additionally, the static mixer 10 can be produced using less materials overall.

Figure 5C:
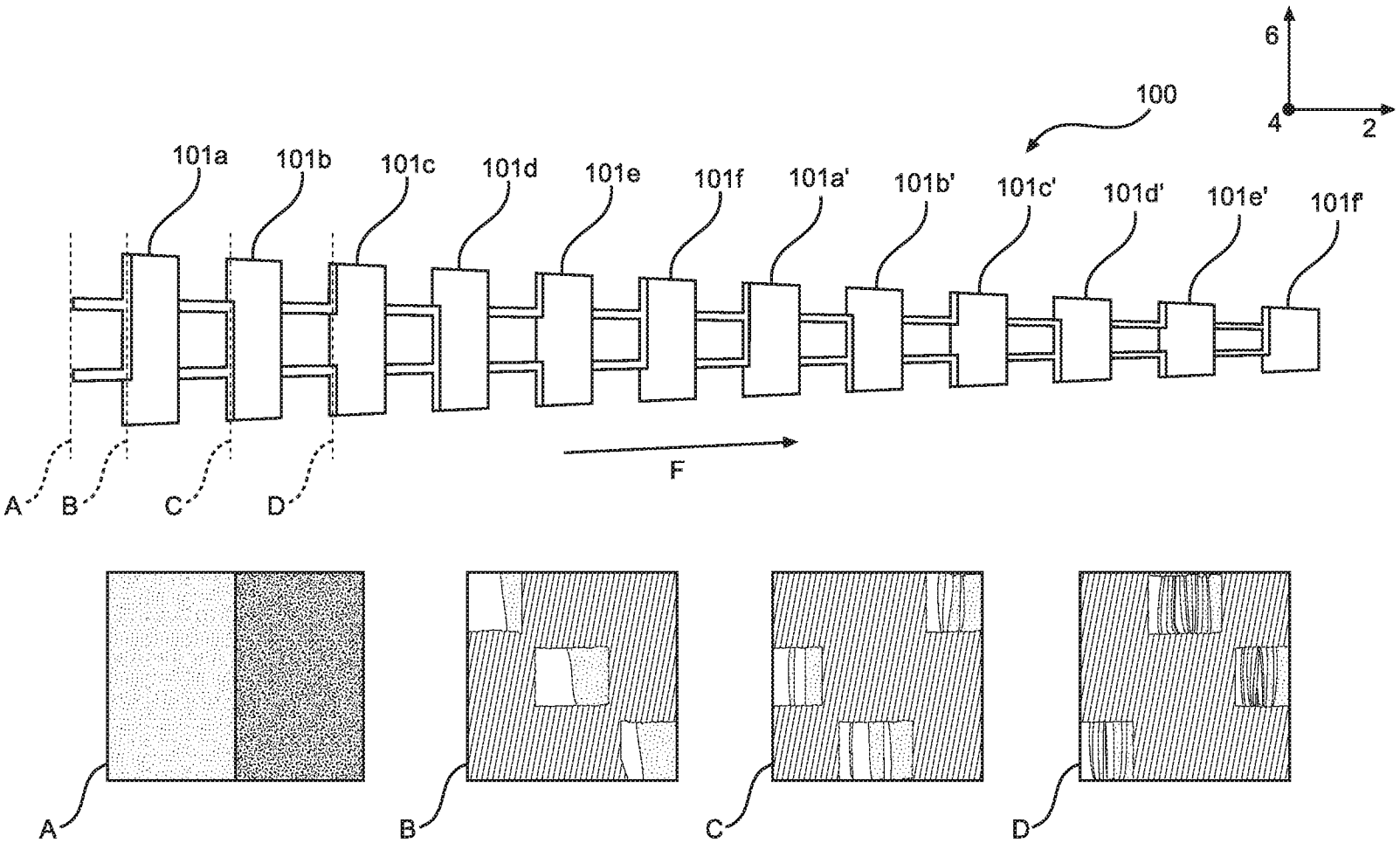
FIG. 5C is a side view of the mixing element shown in FIG. 4, and a schematic view of two fluids flowing through the mixing element at various cross-sections thereof.

The fluid flowing through the mixing element 100 is shown in a simplified schematic in FIG. 5C at various cross sections (A through D) thereof to help clarify the following description. The fluid flow in cross section A is shown before it encounters the first mixing baffle 101*a*. As such, cross section A represents a fluid flow of two unmixed fluids. The fluid flow in cross section B is shown as it encounters the first mixing baffle 101*a* at cross section B, the fluid flow in cross section C is shown as it encounters the second mixing baffle 101*b* at cross section C, and the fluid flow in cross section D is shown as it encounters the third mixing baffle 101*c* at cross section D. As shown, each of the mixing baffles 101 functions to divide the fluid flow into three relatively equal flows and mix the fluids as they flow through the mixing element 100. After the fluids pass entirely through the mixing element 100, a cross section of the fluid flow will show a homogenous mixture without any of the streaks shown in cross sections A through D.

Continuing with FIGS. 6A-6B, the first mixing baffle 101*a* will be described. Though the first mixing baffle 101*a* is specifically described, the features and elements of the first mixing baffle 101*a* can be equally representative of the first mixing baffle 101*a*', as well as the mixing baffles 101 that define mirror images of the first mixing baffle 101*a* (i.e., fourth mixing baffles 101*d* and 101*d*'). The first mixing baffle 101*a* includes a first dividing panel 112 and a second dividing panel 114 spaced from the first dividing panel 112 along the transverse direction 6. Each of the first and second dividing panels 112 and 114 can substantially comprise rectangular prisms. However, other shapes of first and second dividing panels 112 and 114 are contemplated. The first dividing panel 112 defines a top side 112*a*, a bottom side 112*b* opposite the top side 112*a* along the transverse direction 6, a first side 112*c*, a second side 112*d* opposite the first side 112*c* along the lateral direction 4, a front side 112*e*, and a rear side 112*f* opposite the front side 112*e* along the longitudinal direction 2. Similarly, the second dividing panel 114 defines a top side 114*a*, a bottom side 114*b* opposite the top side 114*a* along the transverse direction 6, a first side 112*c*, a second side 112*d* opposite the first side 112*c* along the lateral direction 4, a front side 114*e*, and a rear side 114*f* opposite the front side 114*e* along the longitudinal direction 2. The second dividing panel 114 can be spaced below the first dividing panel 112, such that the bottom side 112*b* of the first dividing panel 112 faces the top side 114*a* of the second dividing panel 114.

As described above, the first mixing baffle 101*a* defines a first width $W_1$ measured at a first location from the first side 112*c* to the second side 112*d* along the lateral direction 4, and a second width $W_2$ at a second location spaced from the first location along the longitudinal direction 2, such that the first width $W_1$ is greater than the second width $W_2$. As shown in FIG. 6A, the first and second widths $W_1$ and $W_2$ can be measured along the first dividing panel 112. However, the first and second widths $W_1$ and $W_2$ may also be measured along the second dividing panel 114. Though only two widths are specifically enumerated, the first dividing panel 112 and/or the second dividing panel 114 can be continuously tapered along the longitudinal direction 2.

The first mixing baffle 101*a* also includes multiple deflecting panels. Specifically, the first mixing baffle 101*a* defines a first deflecting panel 118 that extends from the top side 112*a* of the first dividing panel 112 along the transverse direction 6, and terminates at a top side 118*a*. The first deflecting panel 118 defines a first side 118*b*, a second side 118*c* opposite the first side 118*b* along the lateral direction 4, a front side 118*d*, and a rear side 118*e* opposite the front side 118*d* along the longitudinal direction 2. The first deflecting panel 118 is configured to obstruct a first portion of the fluid flow along the top side 112*a* of the first dividing panel 112, as will be discussed further below. Additionally, the first mixing baffle 101*a* defines a second deflecting panel 122 that extends from the bottom side 114*b* of the second dividing panel 114 along the transverse direction 6, and terminates at a bottom side 122*a*. The second deflecting panel 122 defines a first side 122*b*, a second side 122*c* opposite the first side 122*b* along the lateral direction 4, a front side 122*d*, and a rear side 122*e* opposite the front side 122*d* along the longitudinal direction 2. The second deflecting panel 122 is configured to obstruct a second portion of the fluid flow along the bottom side 114*b* of the second dividing panel 114, as will be discussed further below.

Further, the first mixing baffle 101*a* defines a third deflecting panel 126 that extends from the bottom side 112*b* of the first dividing panel 112 to the top side 114*a* of the second dividing panel 114 along the transverse direction 6, and is configured to obstruct a third portion of the fluid flow between the first and second dividing panels 112 and 114. The third deflecting panel 126 defines a first side 126*a*, a second side 126*b* opposite the first side 126*a* along the lateral direction 4, a front side 126*c*, and a rear side 126*d* opposite the front side 126*c* along the longitudinal direction 2. The first mixing baffle 101*a* also includes a fourth deflecting panel 130 that extends from the bottom side 112*b* of the first dividing panel 112 to the top side 114*a* of the second dividing panel 114 along the transverse direction 6, and is configured to, along with the third deflecting panel 126, obstruct the third portion of the fluid flow between the first and second dividing panels 112 and 114. The fourth deflecting panel 130 defines a first side 130*a*, a second side 130*b* opposite the first side 130*a* along the lateral direction 4, a front side 130*c*, and a rear side 130*d* opposite the front side 130*c* along the longitudinal direction 2. The fourth deflecting panel 130 is spaced from the third deflecting panel 126 along the lateral direction 4, and is spaced from the first and second deflecting panels 118 and 122 along the transverse direction 6.

The fluid flowing through the first mixing baffle 101*a* is directed by these various surfaces as follows. Upon reaching the first mixing baffle 101*a*, fluid flowing through the mixing passage 48 is divided by the first and second dividing panels 112 and 114 into three relatively equal flows, where one portion of the fluid flow flows along the top side 112*a* of the first dividing panel 112, a second portion of the fluid flow flows along the bottom side 114*b* of the second dividing panel 114, and a third portion of the fluid flow flows between the first and second dividing panels 112 and 114. The first deflecting panel 118 is configured to partially obstruct the first portion of the fluid flow, such that the first portion of the fluid flow travels toward the space adjacent the top left side of the first dividing panel 112. The second deflecting panel 122 is configured to partially obstruct the second portion of the fluid flow, such that the second portion of the fluid flow travels toward the space adjacent the bottom right side of the second dividing panel 114. The third and fourth deflecting panels 126 and 130 are configured to partially obstruct the third portion of the fluid flow, such that the third portion of the fluid flow travels toward the space at the center of the first mixing baffle 101*a*, between the first and second dividing panels 112 and 114 and between the third and fourth deflecting panels 126 and 130. This flow pattern is schematically depicted in cross section B of FIG. 5C. Thus, as shown by the cross sections shown in FIG. 5C and the above description, the mixing baffles 101 of the mixing element 100 generally selectively occlude the flow of fluid through the mixing passage 48 according to a square 3×3 grid arrangement.

Figure 6A:
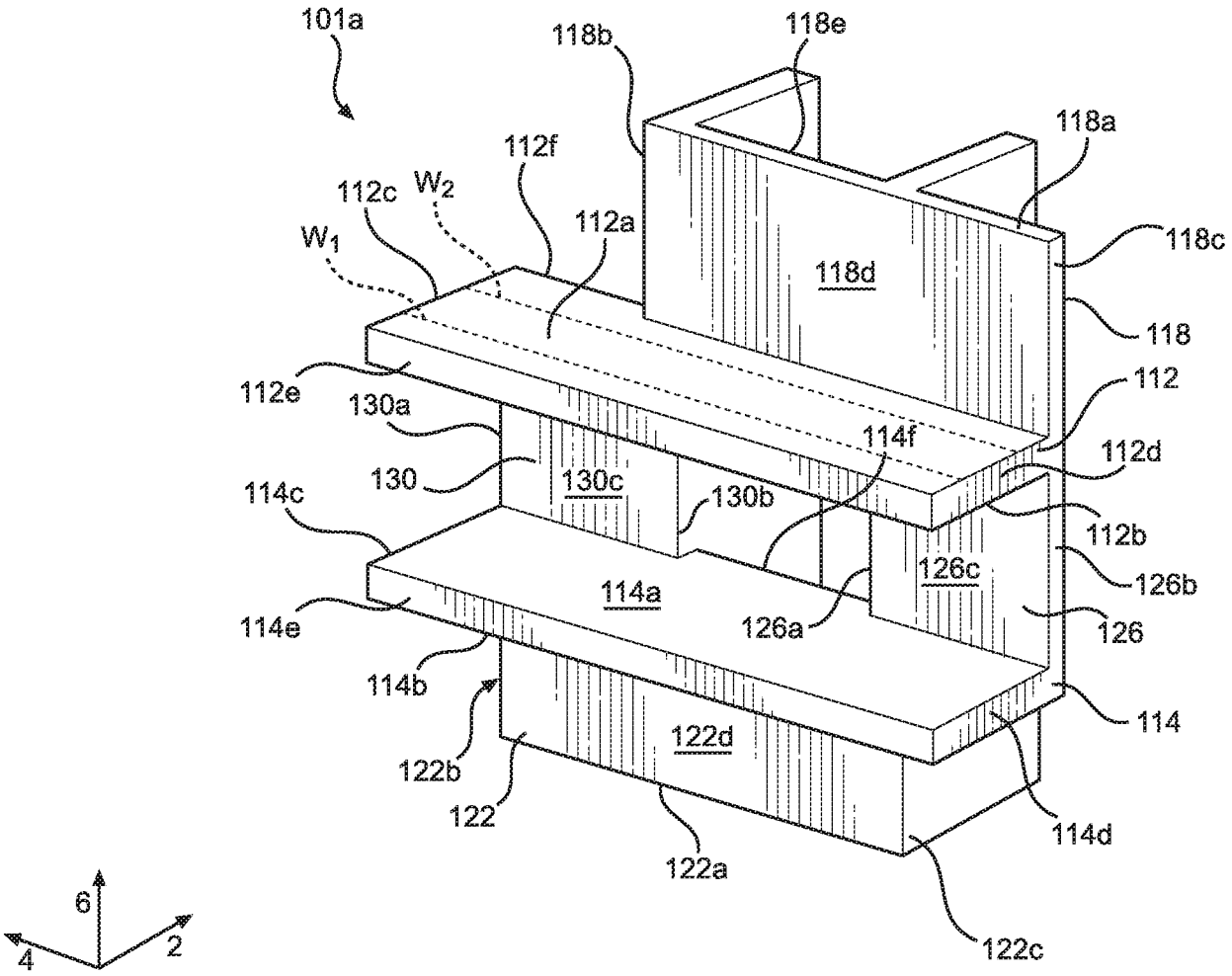
FIG. 6A is a front perspective view of the first mixing baffle shown in FIG. 4.
Figure 6B:
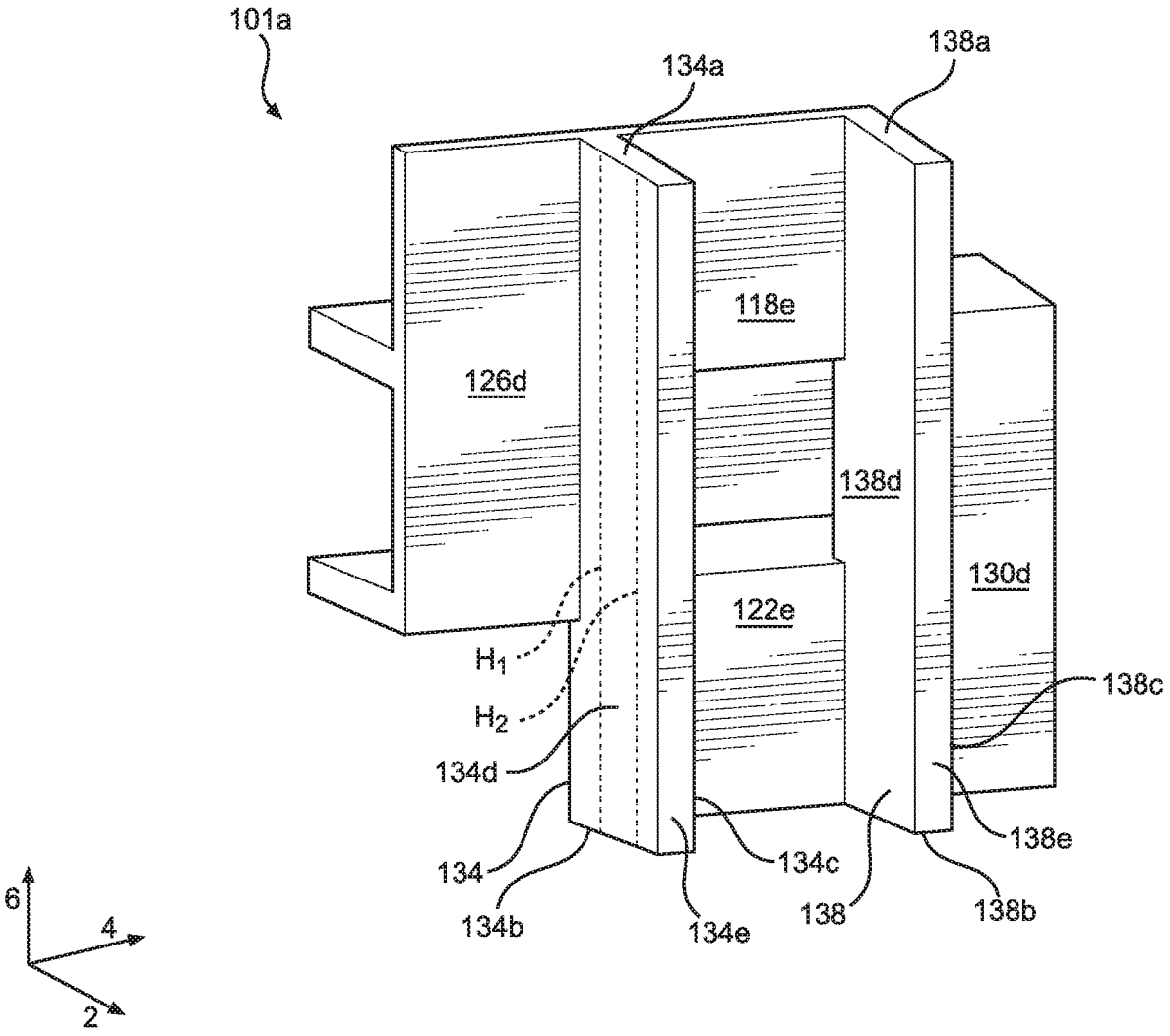
FIG. 6B is a rear perspective view of the first mixing baffle shown in FIG. 6A.

Continuing with FIGS. 6A and 6B, the first mixing baffle 101*a* further includes a first mixing panel 134 and a second mixing panel 138 that each extends from the first and second dividing panels 112 and 114 along the longitudinal direction 2. The first and second mixing panels 134 and 138 are spaced apart along the lateral direction 4, and can be substantially parallel to each other. Additionally, the first and second mixing panels 134 and 138 can be substantially perpendicular to the first and second dividing panels 112 and 114. The first mixing panel 134 defines a top side 134*a*, a bottom side 134*b* opposite the top side 134*a* along the transverse direction 6, a first side 134*c*, a second side 134*d* opposite the first side 134*c* along the lateral direction 4, and a rear side 134*e*. Similarly, the second mixing panel 138 defines a top side 138*a*, a bottom side 138*b* opposite the top side 138*a* along the transverse direction 6, a first side 138*c*, a second side 138*d* opposite the first side 138*c* along the lateral direction 4, and a rear side 138*e*. As shown in FIG. 6B, the first mixing panel 134 defines a first height $H_1$ measured at a first location from the top side 134*a* to the bottom side 134*b* along the transverse direction 6, and a second height $H_2$ at a second location spaced from the first location along the longitudinal direction 2, such that the first height $H_1$ is greater than the second height $H_2$. Though the first and second heights $H_1$ and $H_2$ are shown as being measured along the first mixing panel 134, the first and second heights $H_1$ and $H_2$ may also be measured along the second mixing panel 138. Though only two heights are specifically enumerated, the first mixing panel 134 and/or the second mixing panel 138 can be continuously tapered along the longitudinal direction 2. The first and second mixing panels 134 and 138, along with the first and second dividing panels 112 and 114, and the first, second, third, and fourth deflecting panels 118, 122, 126, and 130 can be integrally formed as a unitary member, such as by injection molding a plastic material, as understood in the art.

After the fluid flow has been divided and shifted by the first and second dividing panels 112 and 114, as well as the first, second, third, and fourth deflecting panels 118, 122, 126, and 130, the first and second mixing panels 134 and 138 help to shape the expansion of the first, second, and third portions of the fluid flow. Upon the first portion of the fluid flow traveling through the space adjacent the top left side of the first dividing panel 112, the first portion of the fluid flow expands along the transverse directions 6, such that the first portion of the fluid flow substantially fills an entire left third of the mixing passage 48 defined to the left of the second mixing panel 138. Additionally, upon the second portion of the fluid flow traveling through the space adjacent the bottom right side of the second dividing panel 114, the second portion of the fluid flow expands along the transverse direction 6, such that the second portion of the fluid flow substantially fills an entire right third of the mixing passage 48 defined to the right of the first mixing panel 134. Further, upon the third portion of the fluid flow traveling through the space at the center of the first mixing baffle 101*a* between the first and second dividing panels 112 and 114 and between the third and fourth deflecting panels 126 and 130, the third portion of the fluid flow expands along the transverse direction 6, such that the second portion of the fluid flow substantially fills a center third of the mixing passage 48 defined between the first and second mixing panels 134 and 138. Following this, the fluid flow then encounters the second mixing baffle 101*b*.

Now referring to FIGS. 7A and 7B, the second mixing baffle 101*b* will be described. Though the second mixing baffle 101*b* is specifically described, the features and elements of the second mixing baffle 101*b* can be equally representative of the second mixing baffle 101*b*', as well as the mixing baffles 101 that define mirror images of the second mixing baffle 101*b* (i.e., fifth mixing baffles 101*e* and 101*e*'). The second mixing baffle 101*b*, like the first mixing baffle 101*a*, includes a first dividing panel 146 and a second dividing panel 150 spaced from the first dividing panel 146 along the transverse direction 6. Each of the first and second dividing panels 146 and 150 can substantially comprise rectangular prisms. However, other shapes of the first and second dividing panels 146 and 150 are contemplated. The first dividing panel 146 defines a top side 146*a*, a bottom side 146*b* opposite the top side 146*a* along the transverse direction 6, a first side 146*c*, a second side 146*d* opposite the first side 146*c* along the lateral direction 4, a front side 146*e*, and a rear side 146*f* opposite the front side 146*e* along the longitudinal direction 2. Similarly, the second dividing panel 150 defines a top side 150*a*, a bottom side 150*b* opposite the top side 150*a* along the transverse direction 6, a first side 150*c*, a second side 150*d* opposite the first side 150*c* along the lateral direction 4, a front side 150*e*, and a rear side 150*f* opposite the front side 150*e* along the longitudinal direction 2. The second dividing panel 150 can be spaced below the first dividing panel 146, such that the bottom side 146*b* of the first dividing panel 146 faces the top side 150*a* of the second dividing panel 150.

As described above, the second mixing baffle 101*b* defines a first width $W_3$ measured at a first location from the first side 146*c* to the second side 146*d* of the first dividing panel 146 along the lateral direction 4, and a second width $W_4$ measured at a second location spaced from the first location along the longitudinal direction 2, such that the first width $W_3$ is greater than the second width $W_4$. As shown in FIG. 7A, the first and second widths $W_3$ and $W_4$ can be measured along the first dividing panel 146. However, the first and second widths $W_3$ and $W_4$ may also be measured along the second dividing panel 150. Though only two widths are specifically enumerated, the first dividing panel 146 and/or the second dividing panel 150 can be continuously tapered along the longitudinal direction 2. Further, due to the tapered nature of the mixing element 100, the first and second widths $W_3$ and $W_4$ of the second mixing baffle 101*b* are both smaller than the first and second widths $W_1$ and $W_2$ of the first mixing baffle 101*a*.

The second mixing baffle 101*b*, like the first mixing baffle 101*a*, also includes multiple deflecting panels. Specifically, the second mixing baffle 101*b* includes a first deflecting panel 154 that extends from the top side 146*a* of the first dividing panel 146 along the transverse direction 6, and terminates at a top side 154*a*. The first deflecting panel defines a first side 154*b*, a second side 154*c* opposite the first side 154*b* along the lateral direction 4, a front side 154*d*, and a rear side 154*e* opposite the front side 154*d* along the longitudinal direction 2. The first deflecting panel 154 is configured to obstruct a first portion of the fluid flow along the top side 146*a* of the first dividing panel 146, as will be discussed further below. Additionally, the second mixing baffle 101*b* defines a second deflecting panel 158 that extends from the bottom side 150*b* of the second dividing panel 150 along the transverse direction 6, and terminates at a bottom side 158*a*. The second deflecting panel 158 defines a first side 158*b*, a second side 158*c* opposite the first side 158*b* along the lateral direction 4, a front side 158*d*, and a rear side 158*e* opposite the front side 158*d* along the longitudinal direction 2. The second deflecting panel 158 is configured to obstruct a second portion of the fluid flow along the bottom side 150*b* of the second dividing panel 150, as will be discussed further below.

Additionally, the second mixing baffle 101*b* defines a third deflecting panel 162 that extends from the bottom side 146*b* of the first dividing panel 146 to the top side 150*a* of the second dividing panel 150 along the transverse direction 6, and is configured to obstruct a third portion of the fluid flow between the first and second dividing panels 146 and 150. The second mixing baffle 101*b* also includes a fourth deflecting panel 166 that extends from the bottom side 150*b* of the second dividing panel 150 along the transverse direction 6, and terminates at a bottom side 166*a*. The fourth deflecting panel 166 also defines a first side 166*b*, a second side 166*c* opposite the first side 166*b* along the lateral direction 4, a front side 166*d*, and a rear side 166*e* opposite the front side 166*d* along the longitudinal direction 2. The fourth deflecting panel 166 is also configured to partially obstruct the second portion of fluid flow along the bottom side 150*b* of the second dividing panel 150.

The fluid flowing through the second mixing baffle 101*b* is directed by these various surfaces as follows. Upon reaching the second mixing baffle 101*b*, fluid flowing through the mixing passage 48 is already partially mixed by the first mixing baffle 101*a*. The fluid flow then is divided by the first and second dividing panels 146 and 150 of the second mixing baffle 101*b* into three relatively equal flows, where one portion of the fluid flow flows along the top side 146*a* of the first dividing panel 146, a second portion of the fluid flow flows along the bottom side 150*b* of the second dividing panel 150, and a third portion of the fluid flow flows between the first and second dividing panels 146 and 150. The first deflecting panel 154 is configured to partially obstruct the first portion of the fluid flow, such that the first portion of the fluid flow travels toward the space at the top right of the first dividing panel 146 to the right of the first deflecting panel 154. The second and fourth deflecting panels 158 and 166 are configured to partially obstruct the second portion of the fluid flow, such that the second portion of the fluid flow travels toward the space adjacent the bottom center of the second dividing panel 150, between the second and fourth deflecting panels 158 and 166. The third deflecting panel 162 is configured to partially obstruct the third portion of the fluid flow, such that the third portion of the fluid flow travels toward the space to the left of the center of the second mixing baffle 101*b*, between the first and second dividing panels 146 and 150. The flow pattern is schematically depicted in cross section C of FIG. 5C.

Figure 7A:
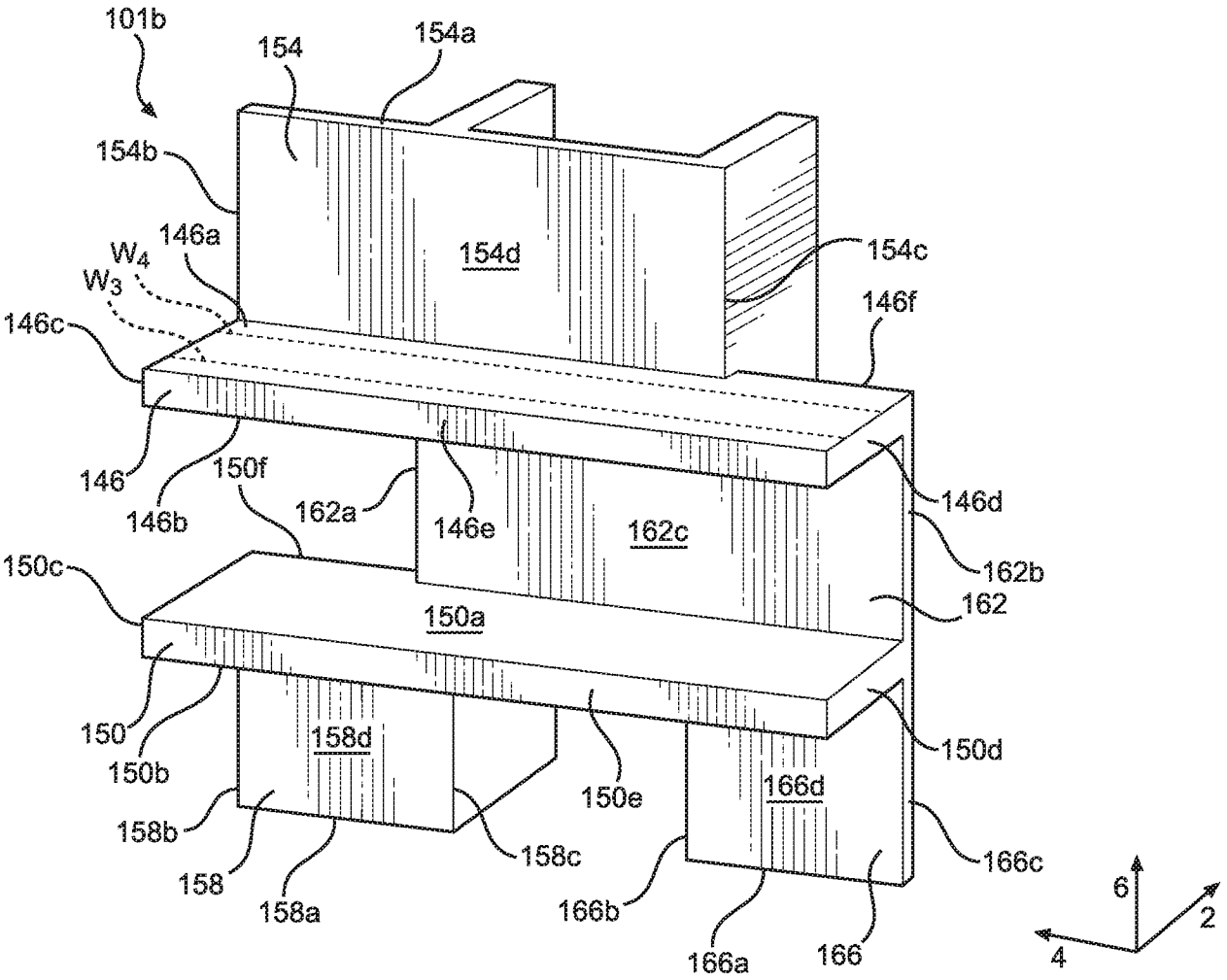
FIG. 7A is a front perspective view of the second mixing baffle shown in FIG. 4.
Figure 7B:
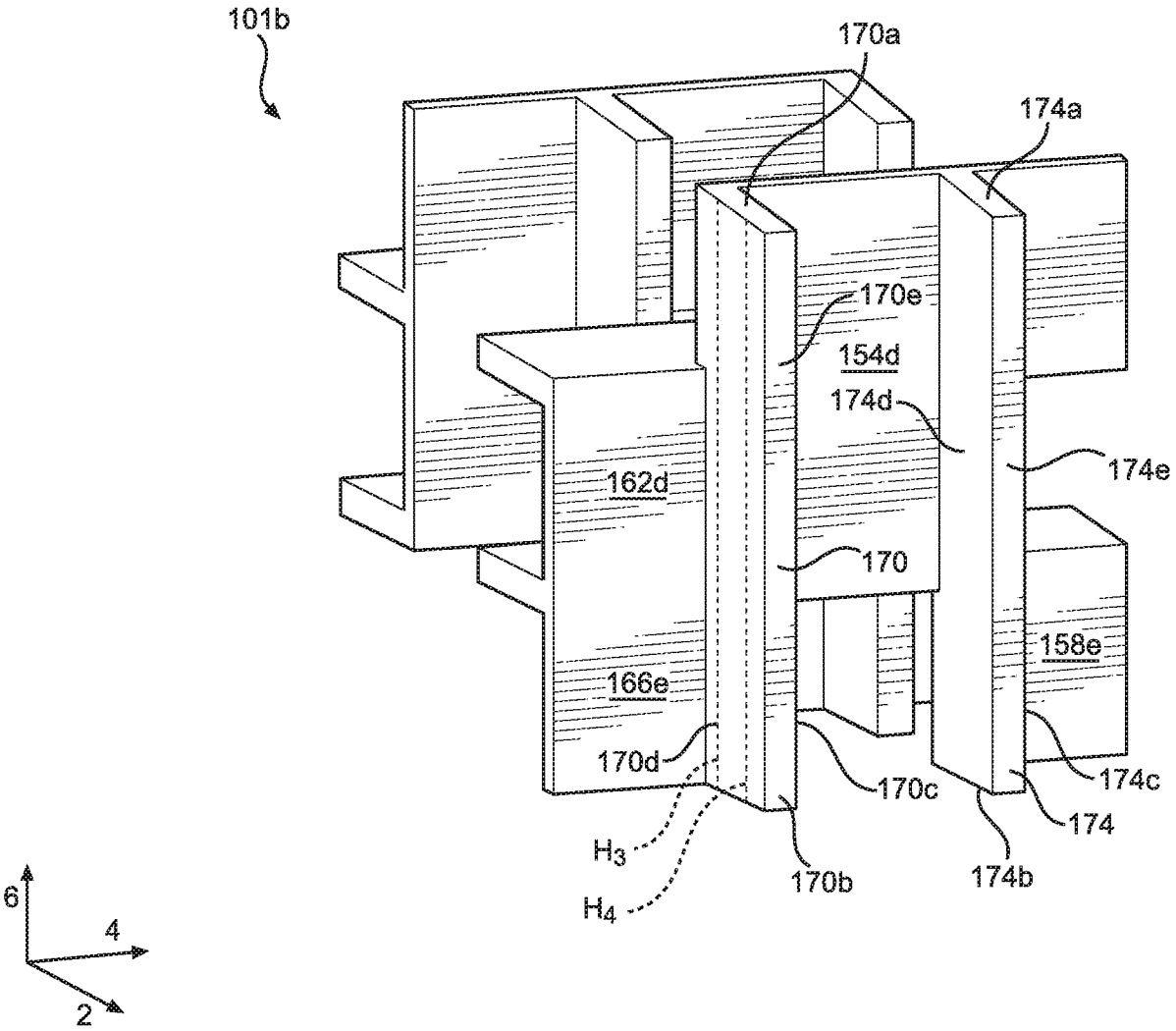
FIG. 7B is a rear perspective view of the second mixing baffle shown in FIG. 7A.

Continuing with FIGS. 7A and 7B, the second mixing baffle 101*b* further includes a first mixing panel 170 and a second mixing panel 174 that each extend from the first and second dividing panels 146 and 150 along the longitudinal direction 2. The first and second mixing panels 170 and 174 are spaced apart along the lateral direction 4, and can be substantially parallel to each other. Additionally, the first and second mixing panels 170 and 174 can be substantially perpendicular to the first and second dividing panels 146 and 150. The first mixing panel 170 defines a top side 170*a*, a bottom side 170*b* opposite the top side 170*a* along the transverse direction 6, a first side 170*c*, a second side 170*d* opposite the first side 170*c* along the lateral direction 4, and a rear side 170*e*. Similarly, the second mixing panel 174 defines a top side 174*a*, a bottom side 174*b* opposite the top side 174*a* along the transverse direction 6, a first side 174*c*, a second side 174*d* opposite the first side 174*c* along the lateral direction 4, and a rear side 174*e*. As shown in FIG. 7B, the first mixing panel 170 defines a first height $H_3$ measured at a first location from the top side 170*a* to the bottom side 170*b* along the transverse direction 6, and a second height $H_4$ at a second location spaced from the first location along the longitudinal direction 2, such that the first height $H_3$ is greater than the second height $H_4$. Though the first and second heights $H_3$ and $H_4$ are shown as being measured along the first mixing panel 170, the first and second heights $H_3$ and $H_4$ may also be measured along the second mixing panel 174. Though only two heights are specifically enumerated, the first mixing panel 170 and/or the second mixing panel 174 can be continuously tapered along the longitudinal direction 2. The first and second mixing panels 170 and 174, along with the first and second dividing panels 146 and 150, as well as the first, second, third, and fourth deflecting panels 154, 158, 162, and 166 can be integrally formed as a unitary member, such as by injection molding a plastic material, as understood in the art. Further, due to the tapered nature of the mixing element 100, the first and second heights $H_3$ and $H_4$ of the second mixing baffle 101*b* can be less than the first and second heights $H_1$ and $H_2$ of the first mixing baffle 101*a*.

After the fluid flow has been divided and shifted by the first and second dividing panels 146 and 150, as well as the first, second, third, and fourth deflecting panels 154, 158, 162, and 166, the first and second mixing panels 170 and 174 help to shape the expansion of the first, second, and third portions of the fluid flow. Upon the first portion of the fluid flow traveling through the space adjacent the top right of the first dividing panel 146 to the right of the first deflecting panel 154, the first portion of the fluid flow expands along the transverse direction 6, such that the first portion of the fluid flow substantially fills an entire right third of the mixing passage 48 defined to the right of the first mixing panel 170. Additionally, upon the second portion of the fluid flow traveling through the space adjacent the bottom center of the second dividing panel 150 between the second and fourth deflecting panels 158 and 166, the second portion of the fluid flow expands along the transverse direction 6, such that the second portion of the fluid flow substantially fills an entire center third of the mixing passage 48 defined between the first and second mixing panels 170 and 174. Also, upon the third portion of the fluid flow traveling through the space to the left of the center of the second mixing baffle 101*b* between the first and second dividing panels 146 and 150, the third portion of the fluid flow expands along the transverse direction 6, such that the second portion of the fluid flow substantially fills a left third of the mixing passage 48 defined to the left of the second mixing panel 174.

Continuing with FIGS. 8A and 8B, the third mixing baffle 101*c* will be described. Though the third mixing baffle 101*c* is specifically described, the features and elements of the third mixing baffle 101*c* can be equally representative of the third mixing baffle 101*c*', as well as the mixing baffles 101 that define mirror images of the third mixing baffle 101*c* (sixth mixing baffles 101*f* and 101*f*'). The third mixing baffle 101*c*, like the first and second mixing baffles 101*a* and 101*b*, includes a first dividing panel 178 and a second dividing panel 182 spaced from the first dividing panel 178 along the transverse direction 6. Each of the first and second dividing panels 178 and 182 can substantially comprise rectangular prisms. However, other shapes of the first and second dividing panels 178 and 182 are contemplated. The first dividing panel 178 defines a top side 178*a*, a bottom side 178*b* opposite the top side 178*a* along the transverse direction 6, a first side 178*c*, a second side 178*d* opposite the first side 178*c* along the lateral direction 4, a front side 178*e*, and a rear side 178*f* opposite the front side 178*e* along the longitudinal direction 2. Similarly, the second dividing panel 182 defines a top side 182*a*, a bottom side 182*b* opposite the top side 182*a* along the transverse direction 6, a first side 182*c*, a second side 182*d* opposite the first side 182*c* along the lateral direction 4, a front side 182*e*, and a rear side 182*f* opposite the front side 182*e* along the longitudinal direction 2. The second dividing panel 182 can be spaced below the first dividing panel 178, such that the bottom side 178*b* of the first dividing panel 178 faces the top side 182*a* of the second dividing panel 182.

As described above, the third mixing baffle 101*c* defines a first width $W_5$ measured at a first location from the front side 146*e* along the lateral direction 4, and a second width $W_6$ measured at a second location spaced from the first location along the longitudinal direction 2, such that the first width $W_5$ is greater than the second width $W_6$. As shown in FIG. 8A, the first and second widths $W_5$ and $W_6$ can be measured along the first dividing panel 178. However, the first and second widths $W_5$ and $W_6$ can also be measured along the second dividing panel 182. Though only two widths are specifically enumerated, the first dividing panel 178 and/or the second dividing panel 182 can be continuously tapered along the longitudinal direction 2. Further, due to the tapered nature of the mixing element 100, the first and second widths $W_5$ and $W_6$ of the third mixing baffle 101*c* are both smaller than the first and second widths of each of the first and second mixing baffles 101*a* and 101*b*.

The third mixing baffle 101*c*, like the first and second mixing baffles 101*a* and 101*b*, also includes multiple deflecting panels. Specifically, the third mixing baffle 101*c* includes a first deflecting panel 186 that extends from the top side 178*a* of the first dividing panel 178 along the transverse direction 6, and terminates at a top side 186*a*. The first deflecting panel 186 defines a first side 186*b*, a second side 186*c* opposite the first side 186*b* along the lateral direction 4, a front side 186*d*, and a rear side 186*e* opposite the front side 186*d* along the longitudinal direction 2. The first deflecting panel 186 is configured to obstruct a first portion of the fluid flow along the top side 178*a* of the first dividing panel 178, as will be discussed further below. Additionally, the third mixing baffle 101*c* defines a second deflecting panel 188 that extends from the bottom side 182*b* of the second dividing panel 182 along the transverse direction 6, and terminates at a bottom side 188*a*. The second deflecting panel 188 defines a first side 188*b*, a second side 188*c* opposite the first side 188*b* along the lateral direction 4, a front side 188*d*, and a rear side 188*e* opposite the front side 188*d* along the longitudinal direction 2. The second deflecting panel 188 is configured to obstruct a second portion of the fluid flow along the bottom side 182*b* of the second dividing panel 182, as will be discussed further below.

Additionally, the third mixing baffle 101*c* defines a third deflecting panel 190 that extends from the bottom side 178*b* of the first dividing panel 178 to the top side 182*a* of the second dividing panel 182 along the transverse direction 6, and is configured to obstruct a third portion of the fluid flow between the first and second dividing panels 178 and 182. The third deflecting panel 190 defines a first side 190*a*, a second side 190*b* opposite the first side 190*a* along the lateral direction 4, a front side 190*c*, and a rear side 190*d* opposite the front side 190*c* along the longitudinal direction 2. The third mixing baffle 101*c* further includes a fourth deflecting panel 192 that extends from the top side 178*a* of the first dividing panel 178 and terminates at a top side 192*a*. The fourth deflecting panel 192 defines a first side 192*b*, a second side 192*c* opposite the first side 192*b* along the lateral direction 4, a front side 192*d*, and a rear side 192*e* opposite the front side 192*d* along the longitudinal direction 2. The fourth deflecting panel 192 is also configured to partially obstruct the first portion of fluid flow along the top side 178*a* of the first dividing panel 178.

The fluid flowing through the third mixing baffle 101*c* is directed by these various surfaces as follows. Upon reaching the third mixing baffle 101*c*, fluid flowing through the mixing passage 48 has already been partially mixed by the first and second mixing baffles 101*a* and 101*b*. The fluid flow is then divided by the first and second dividing panels 178 and 182 of the third mixing baffle 101*c* into three relatively equal portions, where one portion of the fluid flow flows along the top side 178*a* of the first dividing panel 178, a second portion of the fluid flow flows along the bottom side 182*b* of the second dividing panel 182, and a third portion of the fluid flow flows between the first and second dividing panels 178 and 182. The first and fourth deflecting panels 186 and 192 are configured to partially obstruct the first portion of the fluid flow, such that the first portion of the fluid flow travels toward the space at the top center of the first dividing panel 178. The second deflecting panel 188 is configured to partially obstruct the second portion of the fluid flow, such that the second portion of the fluid flow travels toward the space adjacent the bottom left side of the second dividing panel 182 to the left of the second deflecting panel 188. The third deflecting panel 190 is configured to partially obstruct the third portion of the fluid flow, such that the third portion of the fluid flow travels toward the space to the right of the center of the third mixing baffle 101*c*, between the first and second dividing panels 178 and 182. This flow pattern is schematically depicted in cross section D of FIG. 5C.

Figure 8A:
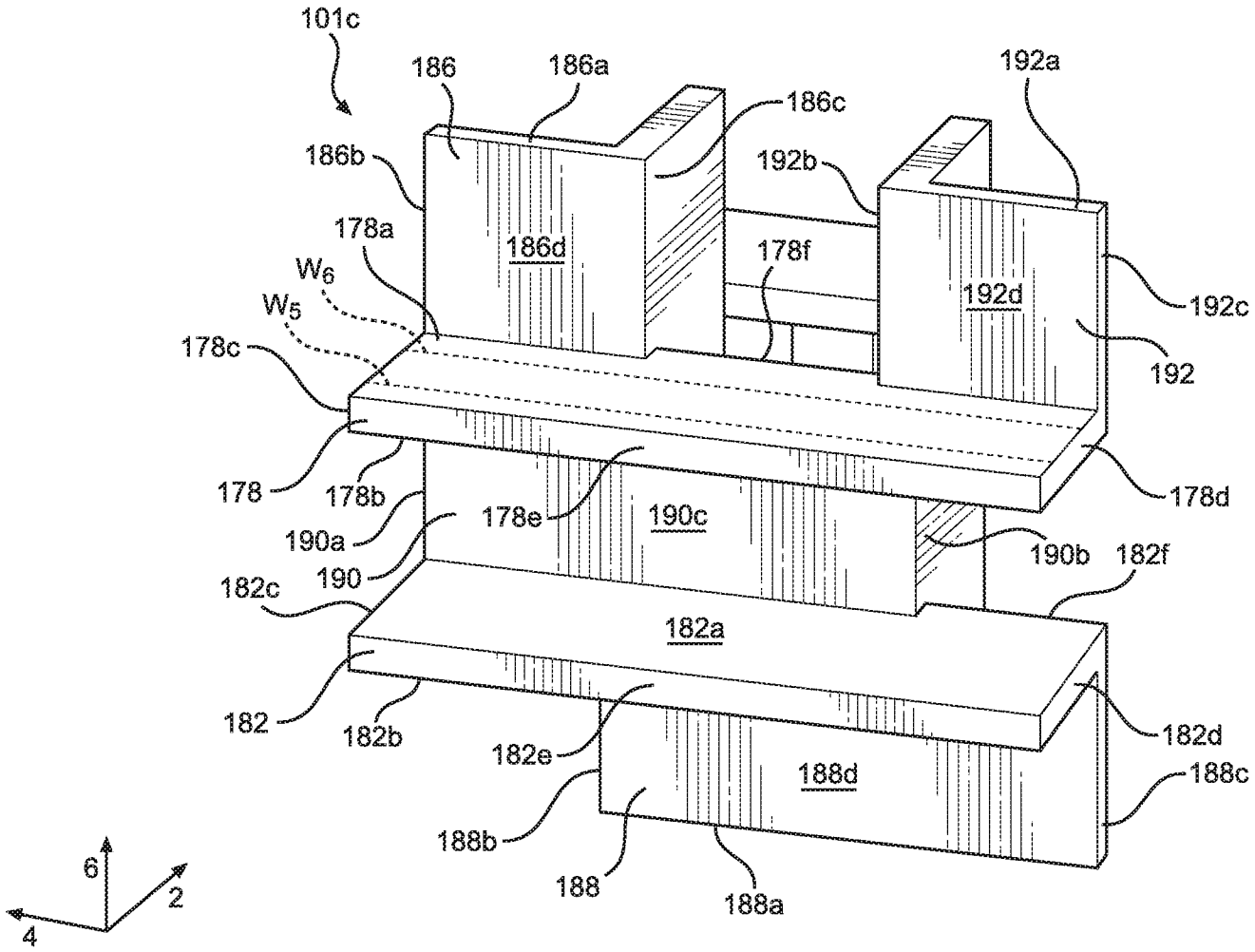
FIG. 8A is a front perspective view of the third mixing baffle shown in FIG. 4.
Figure 8B:
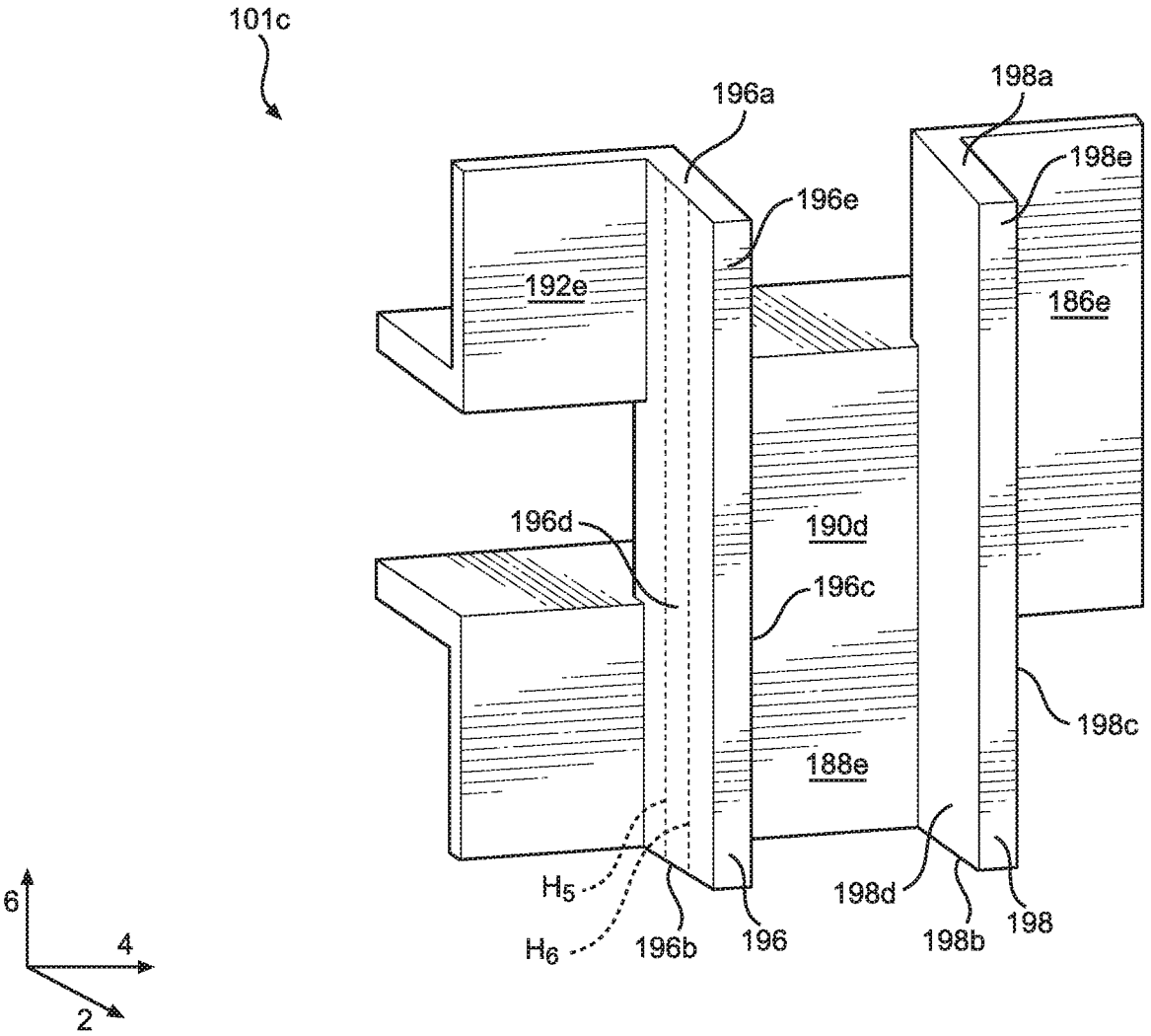
FIG. 8B is a rear perspective view of the third mixing baffle shown in FIG. 8A.

Continuing with FIGS. 8A and 8B, the third mixing baffle 101*c* further includes a first mixing panel 196 and a second mixing panel 198 that each extend from the first and second dividing panels 178 and 182 along the longitudinal direction 2. The first and second mixing panels 196 and 198 are spaced apart along the lateral direction 4, and can be substantially parallel to each other. Additionally, the first and second mixing panels 196 and 198 can be substantially perpendicular to the first and second dividing panels 178 and 182. The first mixing panel 196 defines a top side 196*a*, a bottom side 196*b* opposite the top side 196*a* along the transverse direction 6, a first side 196*c*, a second side 196*d* opposite the first side 196*c* along the lateral direction 4, and a rear side 196*e*. Similarly, the second mixing panel 198 defines a top side 198*a*, a bottom side 198*b* opposite the top side 198*a* along the transverse direction, a first side 198*c*, a second side 198*d* opposite the first side 198*c* along the lateral direction 4, and a rear side 198*e*. As shown in FIG. 8B, the first mixing panel 196 defines a first height $H_5$ measured at a first location from the top side 196*a* to the bottom side 196*b* along the transverse direction 6, and a second height $H_6$ at a second location spaced from the first location along the longitudinal direction 2, such that the first height $H_5$ is greater than the second height $H_6$. Though the first and second heights $H_5$ and $H_6$ are shown as being measured along the first mixing panel 196, the first and second heights $H_5$ and $H_6$ may also be measured along the second mixing panel 198. Though only two heights are specifically enumerated, the first mixing panel 196 and/or the second mixing panel 198 can be continuously tapered along the longitudinal direction 2. The first and second mixing panels 196 and 198, along with the first and second dividing panels 178 and 182, as well as the first, second, third, and fourth deflecting panels 186, 188, 190, and 192 can be integrally formed as a unitary member, such as by injection molding a plastic material, as understood in the art. Further, due to the tapered nature of the mixing element 100, the first and second heights $H_5$ and $H_6$ of the third mixing baffle 101*c* can be less than the first and second heights of the first and second mixing baffles 101*a* and 101*b*.

After the fluid flow has been divided and shifted by the first and second dividing panels 178 and 182, as well as the first, second, third, and fourth deflecting panels 186, 188, 190, and 192, the first and second mixing panels 196 and 198 help to shape the expansion of the first, second, and third portions of the fluid flow. Upon the first portion of the fluid flow traveling through the space adjacent the top center of the first dividing panel 178, the first portion of the fluid flow expands along the transverse direction 6, such that the first portion of the fluid flow substantially fills an entire center third of the mixing passage 48 defined between the first mixing panel 196 and the second mixing panel 198. Additionally, upon the second portion of the fluid flow traveling through the space adjacent the bottom left of the second dividing panel 182, the second portion of the fluid flow expands along the transverse direction 6, such that the second portion of the fluid flow substantially fills an entire left third of the mixing passage 48 defined to the left of the second mixing panel 198. Also, upon the third portion of the fluid flow traveling through the space to the right of the center of the third mixing baffle 101*c*, the third portion of the fluid flow expands along the transverse direction 6, such that the third portion of the fluid flow substantially fills a right third of the mixing passage 48 defined to the right of the first mixing panel 196.

Now referring to FIGS. 9-12D, a mixing element 200 according to another embodiment of the present application will be described. The mixing element 200 is comprised of a leading element 202, as well as an alternating arrangement of left mixing baffles 202*a*-210*a* having a first configuration and right mixing baffles 202*b*-210*b* having a second configuration, which are collectively referred to as mixing baffles 203. The first and second configurations are similar, but reversed about a central plane C (shown in FIG. 10A) that extends in the longitudinal and transverse directions 2 and 6. As a result, the left mixing baffles 202*a*-210*a* and the right mixing baffles 210*b*-210*b* are structurally mirror images of each other. The mixing baffles 203 may be integrally molded, such that the mixing element 200 defines a monolithic structure. Also, like the mixing element 100 described above, mixing element 200 can be integrally formed without the use of sidewalls.

Figure 9:
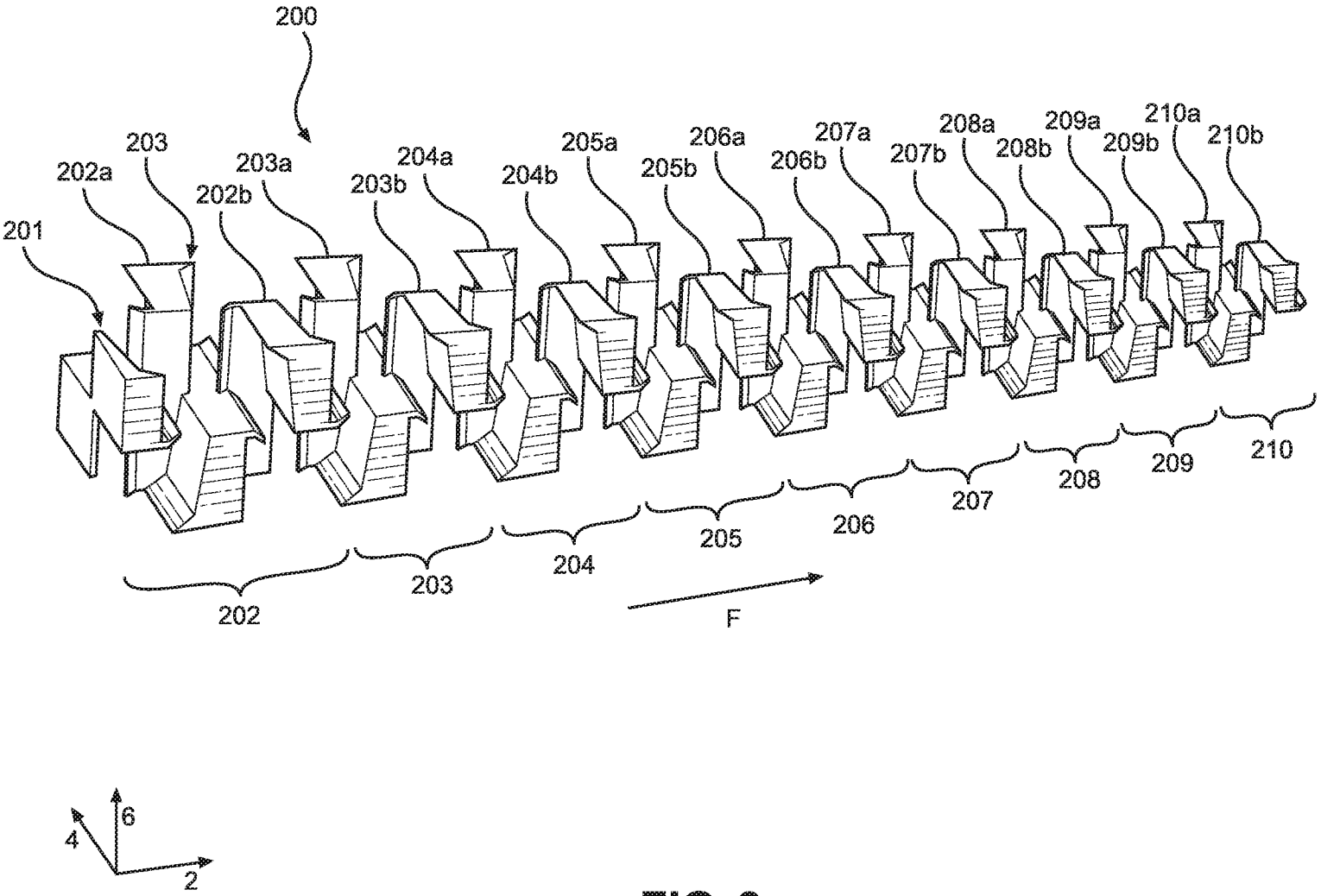
FIG. 9 is a perspective view of a mixing element according to another embodiment of the application.

The mixing element 200 may be divided into mixing baffle pairs 202-210, where each of the mixing baffle pairs 202-210 includes a respective left mixing baffle (one of left mixing baffles 202*a*-210*a*) and a respective right mixing baffle (one of right mixing baffles 202*b*-210*b*). For example, mixing baffle pair 202 includes left mixing baffle 202*a* and right mixing baffle 202*b*. The mixing baffles 203 are generally referred to as "double wedge" mixing baffles as a result of the various flow occluding surfaces described in further detail below. The mixing element 200 is configured such that two or more fluids are mixed as they flow through the mixing element 200, which, like the mixing element 100, can be disposed in the mixing passage 48 of a mixing conduit 20. As shown in FIG. 9, the fluid flow extends substantially along the longitudinal direction 2, from the leading element 201 to the last right mixing baffle 210*b*. Each of the double wedge mixing baffles 203 divides a fluid flow through the mixing passage 48 at a leading edge of the mixing baffles 203, and then shifts or rotates that flow clockwise or counterclockwise before recombining the fluid flow at a trailing edge of the mixing baffle 203 (the leading and trailing edges are numbered below with reference to other Figures). In particular, the fluid flow encountering the right mixing baffles 202*b*-210*b* generally shifts clockwise through the mixing passage 48, while the fluid flow encountering the left mixing baffles 202*a*-210*a* generally shifts counterclockwise through the mixing passage 48. However, this clockwise and counterclockwise movement will be understood to not be rotation, as such a rotation would generally not be helpful in mixing the multiple fluids and avoiding streaking through the static mixer 10.

Though the mixing element 200 is depicted as including one leading element 201 and nine each of the left mixing baffles 202*a*-210*a* and right mixing baffles 202*b*-210*b*, any number of leading elements 201, left mixing baffles 202*a*-210*a*, and right mixing baffles 202*b*-210*b* can be used as desired. Further, the arrangement of mixing baffles 202-210 can be reorganized or modified from that shown without departing from the scope of this disclosure.

Figure 10A:
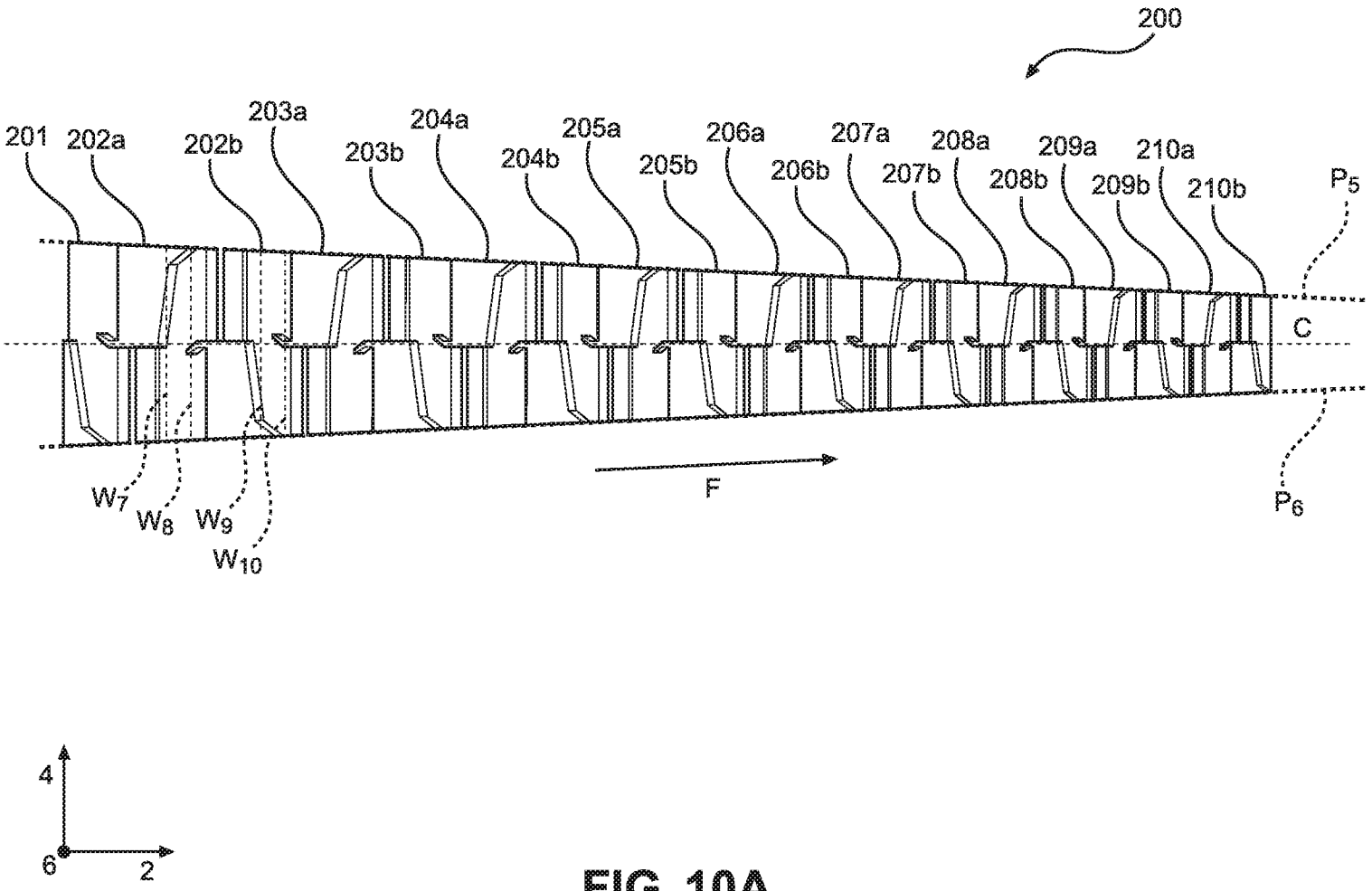
FIG. 10A is a top view of the mixing element shown in FIG. 9.
Figure 10B:
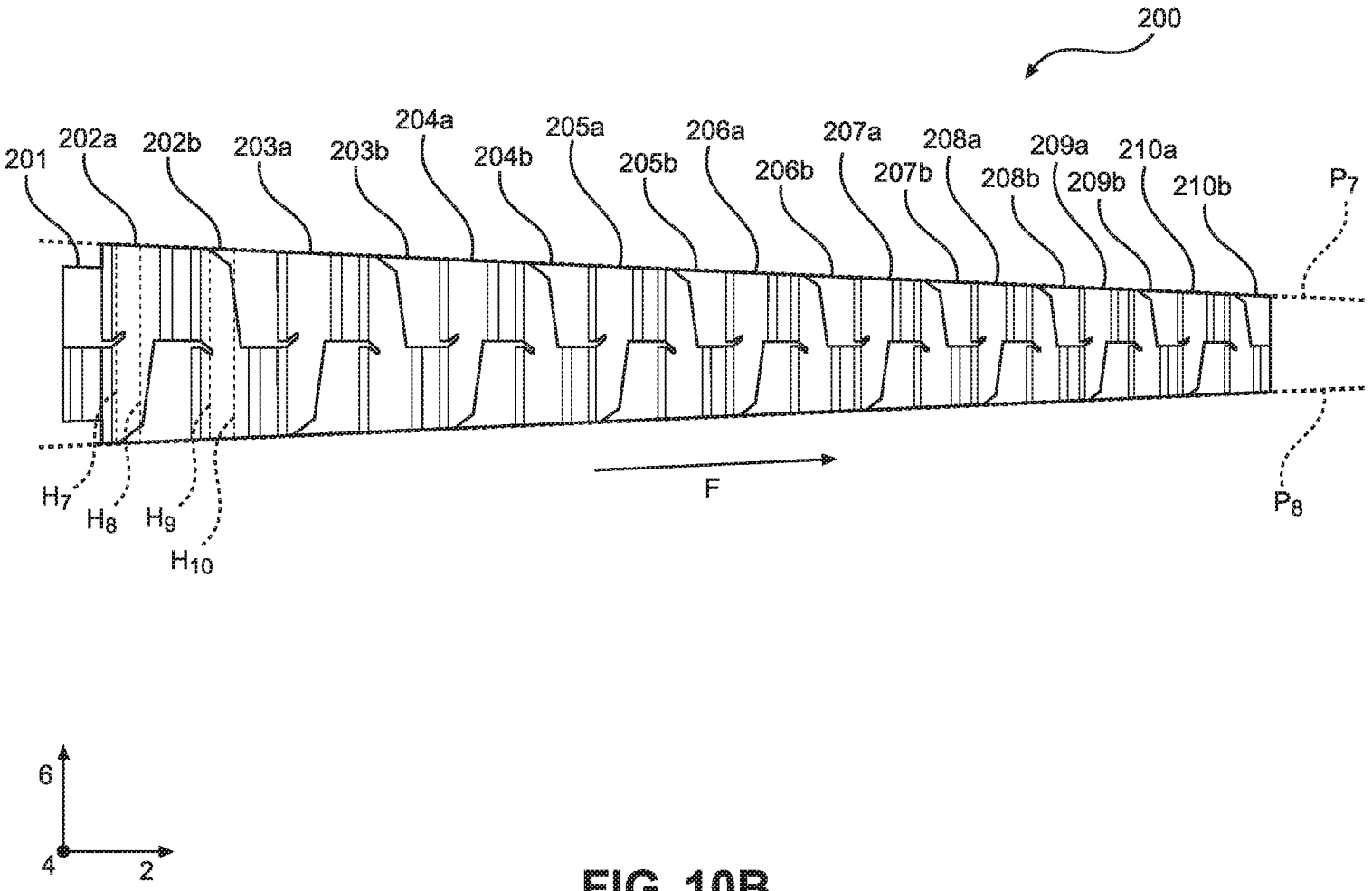
FIG. 10B is a side view of the mixing element shown in FIG. 9.

Like the mixing element 100, the mixing element 200 defines a tapered profile, such that it narrows as it extends along the longitudinal direction 2. As shown in FIGS. 10A and 10B, the mixing element 200 narrows between baffle pair 202 and baffle pair 210. With respect to the width of the mixing element 200, the sides of the mixing element 200 can be contained within respective planes $P_5$ and $P_6$ that are angled towards each with respect to the lateral direction 4 as the planes $P_5$ and $P_6$ extend in the longitudinal direction 2. As a result, each mixing baffle 203 is narrower than the preceding mixing baffle 203 in the mixing element 200 (for example, right mixing baffle 202*b* is narrower than left mixing baffle 202*a*). While the mixing element 200 is tapered such that each mixing baffle 203 is narrower than the preceding mixing baffle, the mixing baffles 203 themselves can be uniformly tapered, such that the mixing baffles 203 narrow as they extend along the longitudinal direction 2. As shown in FIG. 10A, for example, the left mixing baffle 202*a* defines a first width $W_7$ at a first location, and a second width $W_5$ at a second location spaced from the first location along the longitudinal direction 2, such that the first width $W_7$ is greater than the second width $W_5$. Similarly, the right mixing baffle 202*b* defines a first width $W_9$ at a first location, and a second width $W_{10}$ at a second location spaced from the first location along the longitudinal direction 2, such that the first width $W_9$ is greater than the second width $W_{10}$. Though widths with respect to left mixing baffle 202*a* and right mixing baffle 202*b* are discussed here specifically, this is done for exemplary purposes only, and each of the left mixing baffles 202*a*-210*a* and right mixing baffles 202*b*-210*b* can be similarly situated. In one embodiment, each of the first and second widths of the left and right mixing baffles $W_7$-$W_{10}$ are less than 0.20 inches.

With respect to the height of the mixing element 200, the top and bottom of the mixing element 200 can be contained within respective plains $P_7$ and $P_8$ that are angled towards each other with respect to the transverse direction 6 as the planes $P_7$ and $P_8$ extend in the longitudinal direction 2. As a result, each mixing baffle 203 is shorter than the preceding mixing baffle 203 in the mixing element 200 (for example, right mixing baffle 202*b* is shorter than left mixing baffle 202*a*). While the mixing element 200 is tapered such that each mixing baffle is shorter than the preceding mixing baffle, the mixing baffles 203 themselves can be uniformly tapered, such that the mixing baffles 203 shorten as they extend along the longitudinal direction 2. As shown in FIG. 10B, for example, the left mixing baffle 202*a* defines a first height $H_7$ at a first location, and a second height $H_8$ at a second location spaced from the first location along the longitudinal direction, such that the first height $H_7$ is greater than the second height $H_8$. Similarly, the right mixing baffle 202*b* defines a first height $H_9$ at a first location, and a second height $H_{10}$ at a second location spaced from the first location along the longitudinal direction 2, such that the first height $H_9$ is greater than the second height $H_{10}$. Though heights are described here with respect to left mixing baffle 202*a* and right mixing baffle 202*b* specifically, this is done for exemplary purposes, and each of the left mixing baffles 202*a*-210*a* and right mixing baffles 202*b*-210*b* can be similarly situated. In one embodiment, each of the first and second heights of the left and right mixing baffles $H_7$-$H_{10}$ are less than 0.20 inches.

Like the mixing element 100, the tapered heights and widths of the mixing element 200, coupled with the tapered inner surface 38 of the mixing conduit 20, provides several benefits. As fluid pressure within a static mixer increases, the pressure elements of the static mixer increase in the downstream direction. By tapering the heights and widths of the mixing element 200 in the longitudinal direction 2, the top, bottom, and sides of the mixing element 200 directly contact the inner surface 38 of the mixing conduit 20, thus allowing the mixing element 200 to effectively act as a wedge within the mixing passage 48. As such, forces acting on the mixing element 200 are evenly distributed throughout the mixing element 200 and transferred to the mixing conduit 20. This allows the mixing element 200 to be formed without continuous sidewalls. The lack of continuous sidewalls provides several advantages. Due to the lack of continuous sidewalls, the mixing element 200 can be scaled down to overall smaller sizes, which can be formed through injection molding. The removal of sidewalls further reduces an impediment to fluid flow within the mixing passage 48, and allows the mixing conduit 20 to be smaller. Additionally, the static mixer 10 can be produced using less materials overall.

Figure 10C:
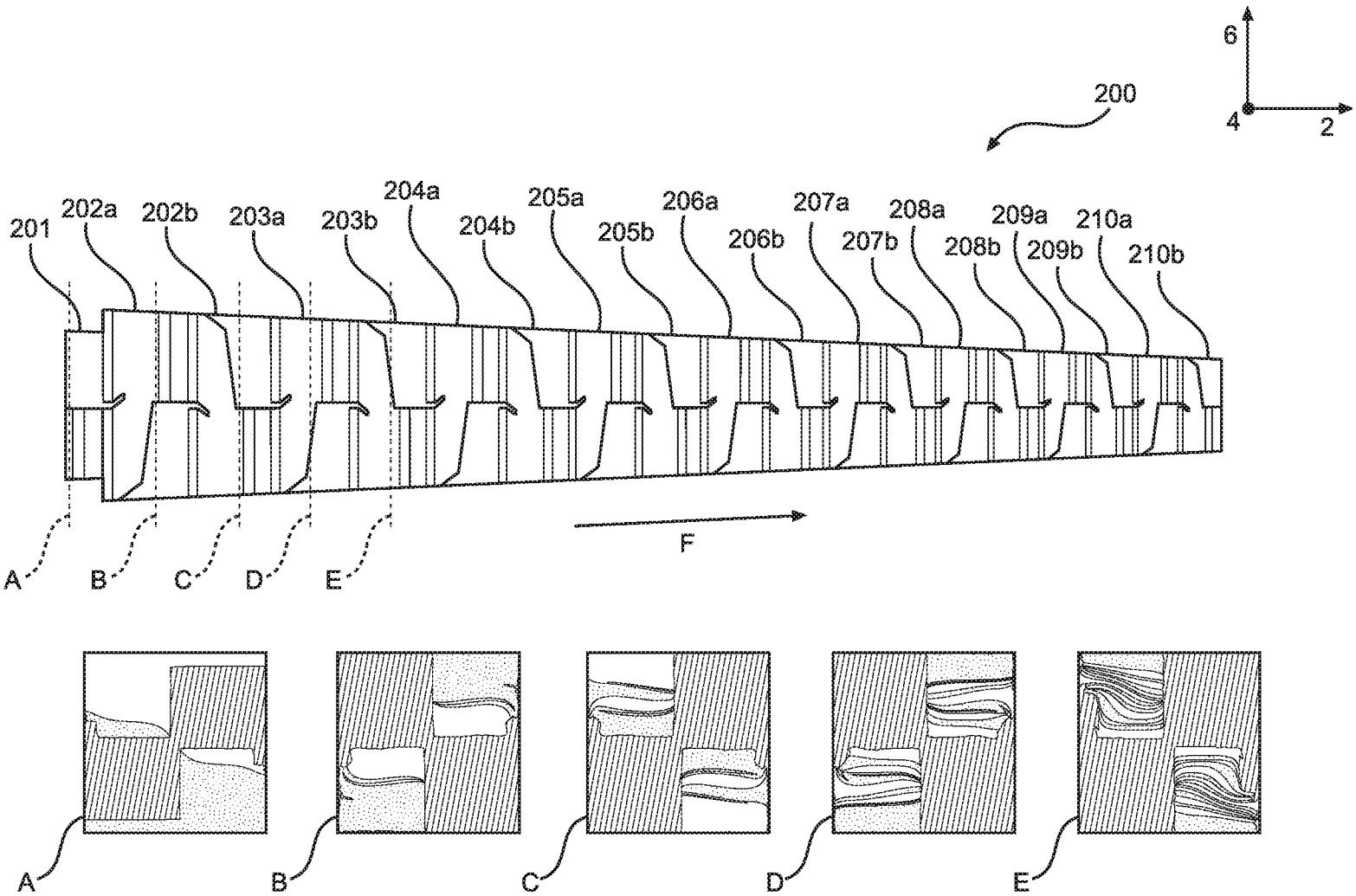
FIG. 10C is a side view of the mixing element shown in FIG. 9, and a schematic view of two fluids flowing through the mixing element at various cross-sections thereof.
Figure 11A:
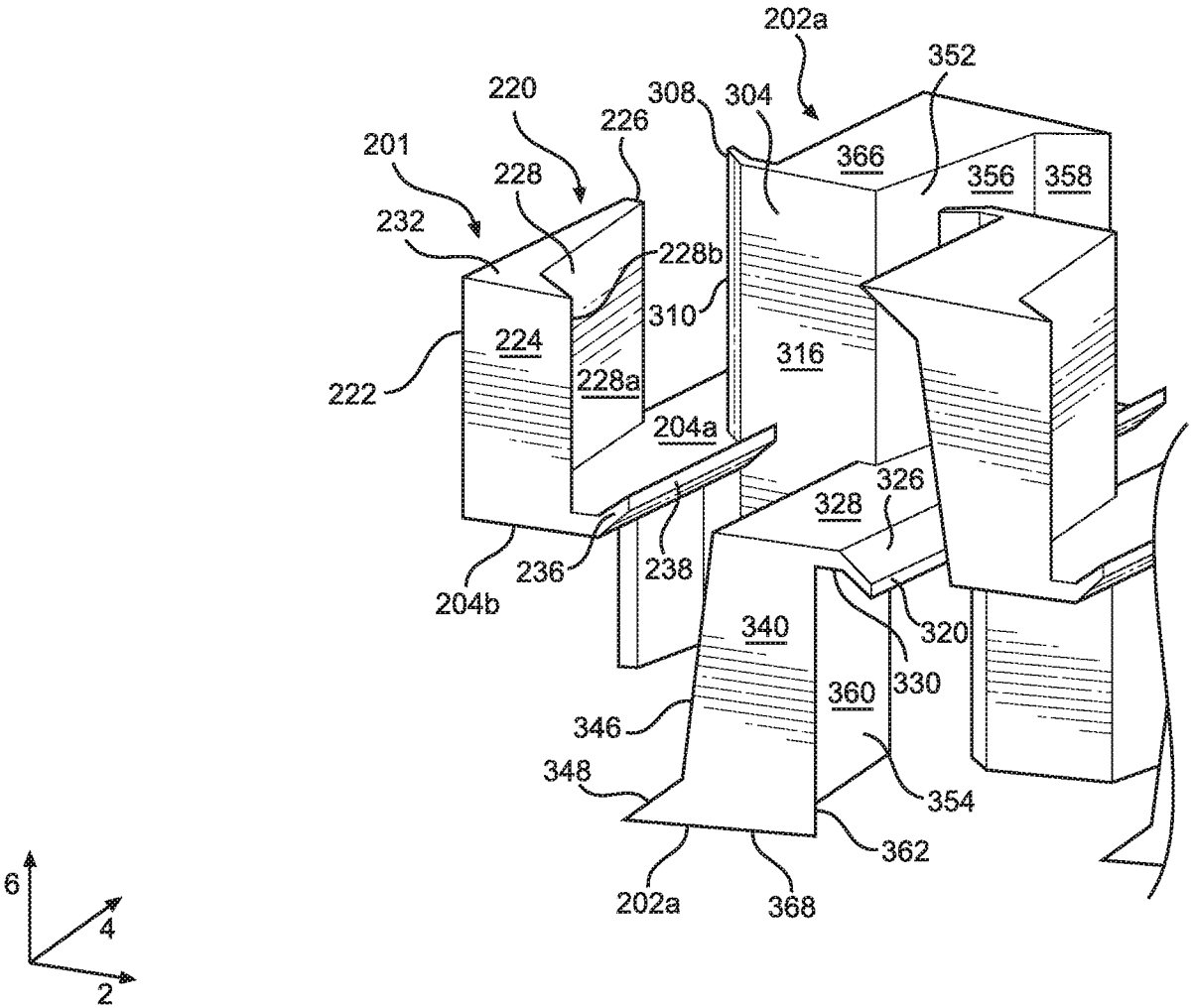
FIG. 11A is right rear perspective view of the leading element and left mixing baffle shown in FIG. 9.
Figure 11B:
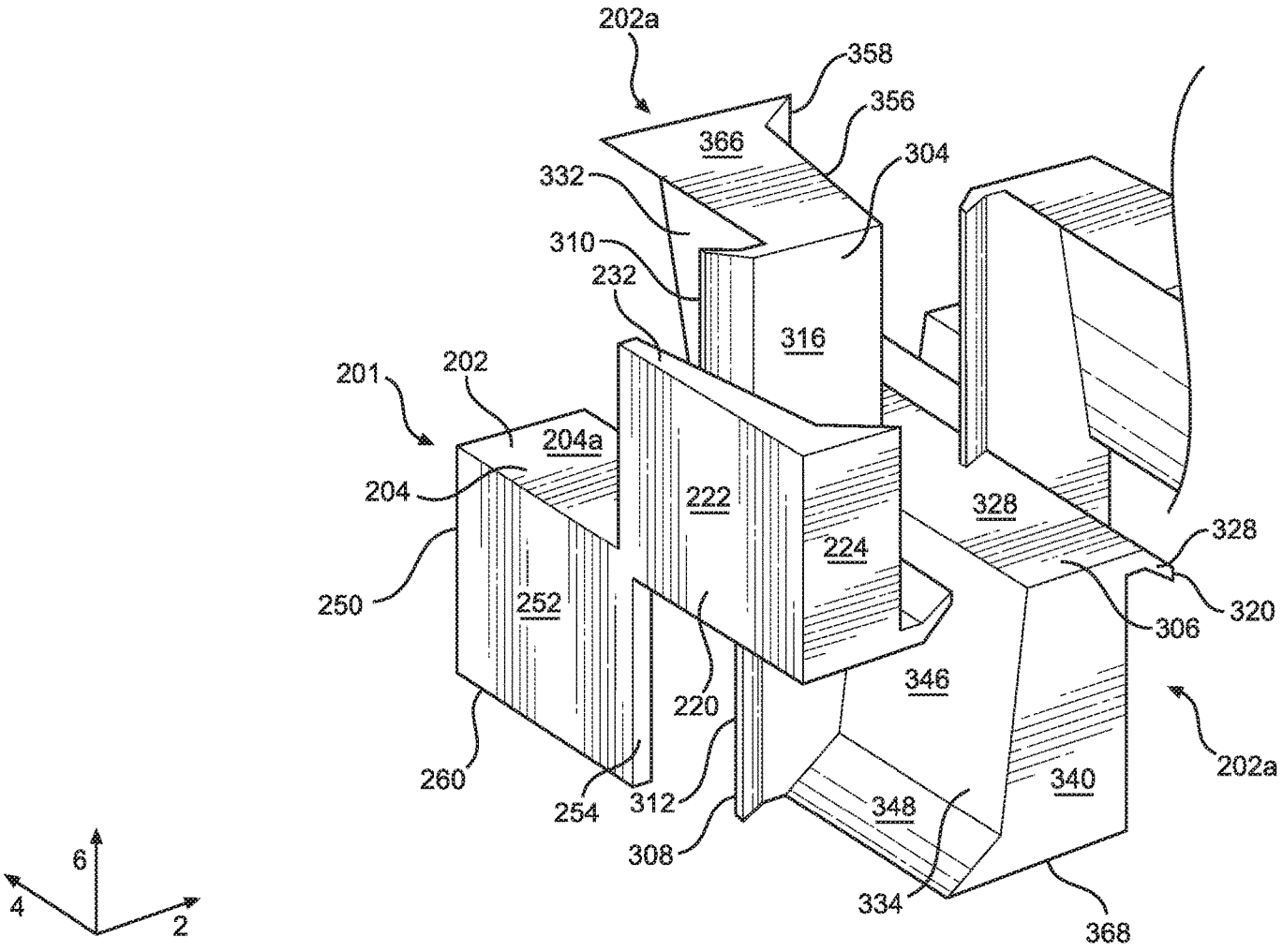
FIG. 11B is a right front perspective view of the leading element and left mixing baffle shown in FIG. 9.
Figure 12C:
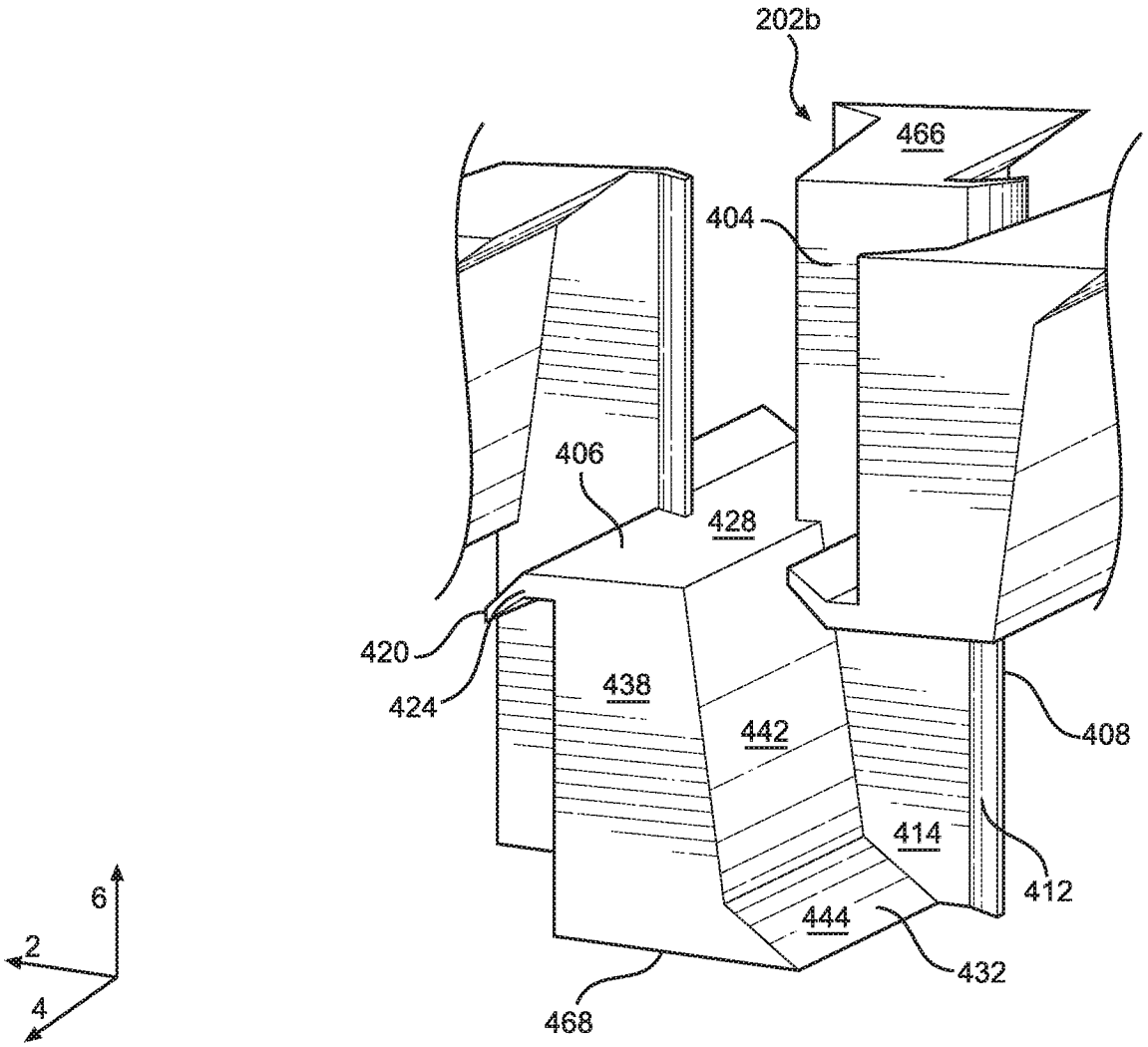
FIG. 12C is a left front perspective view of the right mixing baffle shown in FIG. 9.

The fluid flowing through the mixing element 200 is shown in a simplified schematic in FIG. 10C at various cross sections (A through E) thereof to help clarify the following description. The fluid flow in cross section A is shown as it encounters the leading element 201 at cross section A, the fluid flow in cross section B is shown as it encounters the left mixing baffle 202*a* at cross section B, the fluid flow in cross section C is shown as it encounters the right mixing baffle 202*b* at cross section C, the fluid flow in cross section D is shown as it encounters the left mixing baffle 203*a* at cross section D, and the fluid flow in cross section E is shown as it encounters the right mixing baffle 203*b* at cross section E. As shown, each of the mixing baffles 203 functions to divide the fluid flow into relatively equal left and right flows and mix the fluids as the fluids flow through the mixing element 200. After the fluids pass entirely through the mixing element 200 and past mixing baffle 210*b*, a cross section of the fluid flow will show a homogenous mixture without any of the streaks shown in cross sections A through D.

Now referring to FIGS. 11A-11D, the leading element 201 includes a connecting panel 204 that extends substantially in the lateral direction 4. The connecting panel 204 defines a top surface 204*a*, and a bottom surface 204*b* opposite the top surface 204*a* along the transverse direction 6. Each of the top and bottom surfaces 204*a* and 204*b* may be substantially planar. The leading element 201 can include a first dividing panel 220 that extends from the top surface 204*a* of the connecting panel 204 to a top surface 232 of the leading element 201 along the transverse direction 6, as well as a second dividing panel 250 that extends from the bottom surface 204*b* of the connecting panel 204 to a bottom surface 260 of the leading element 201 along the transverse direction 6. The first dividing panel 220 defines a first deflecting surface 222 and the second dividing panel 250 defines a first deflecting surface 252. The first deflecting surfaces 222 and 252 may be substantially planar and extend away from the connecting panel 204 in substantially opposite directions, as well as define the first aspects of the mixing element 200 that divides the fluid flow. However, in other embodiments the first deflecting surfaces 222 and 252 may be angled as desired. Further, the first dividing panel 220 defines a first side surface 224 and a second side surface 226 opposite the first side surface 224 along the lateral direction 4, while the second dividing panel 250 defines a first side surface 254, and a second side surface 256 opposite the first side surface 254 along the lateral direction 4. The leading element 201 may be configured such that the first side surface 224 of the first dividing panel 220 and the second side surface 256 of the second dividing panel 250 contact the inner surface 38 of the mixing conduit 20 when the mixing element 200 is disposed in the mixing passage 48, while the top surface 232 of the first dividing panel 220 and the bottom surface 260 of the second dividing panel 250 are spaced from the inner surface 38. However, in other embodiments, the leading element 201 may be configured such that the first side surface 224 of the first dividing panel 220 and the second side surface 256 of the second dividing panel 250 are spaced from the inner surface 38 of the mixing conduit 20 when the mixing element 200 is disposed in the mixing passage, while the top surface 232 of the first dividing panel 220 and the bottom surface 260 of the second dividing panel 250 contact the inner surface 38.

The fluid flowing through the mixing element 200 is first divided by the leading element 201, specifically the first dividing panel 220 and the second dividing panel 250. The first deflecting surface 222 of the first dividing panel 220 is configured to direct fluid left towards an upper left quadrant of the leading element 201, so that fluid travels toward the space adjacent the top surface 204*a* of the connecting panel 204. Similarly, the first deflecting surface 252 of the second dividing panel 250 is configured to direct fluid right towards a lower right quadrant of the leading element 201, so that fluid travels toward the space adjacent the bottom surface 204*b* of the connecting panel 204. Due to the dimensions of the leading element 201, fluid may also be allowed to flow between the top surface 232 of the first dividing panel 220 and the top inner surface 38*a* of the mixing conduit 20, as well as between the bottom surface 260 of the second dividing panel 250 and the bottom inner surface 38*c* of the mixing conduit 20, while being prevented from flowing between the first side surface 224 of the first dividing panel 220 and the second inner surface 38*d* of the mixing conduit 20, as well as between the second side surface 256 of the second dividing panel 250 and the first inner surface 38*b* of the mixing conduit 20. However, in alternative embodiments, fluid may be permitted to flow between the first side surface 224 of the first dividing panel 220 and the second inner surface 38*d* of the mixing conduit 20, as well as between the second side surface 256 of the second dividing panel 250 and the first inner surface 38*b* of the mixing conduit 20. The flow across the leading element 201 is shown schematically in cross section A (FIG. 10C).

After being shifted or compressed towards the lower right or upper left quadrants, the fluid flow begins to expand laterally to fill substantially all of the space in the mixing passage 48 once again. To enable this flow expansion, the back half (in the longitudinal direction 2 or flow direction F) of the leading element 201 includes additional deflecting surfaces. In particular, the first dividing panel 220 defines a second deflecting surface 228, while the second dividing panel 250 defines a second deflecting surface 258. Advantageously, both of the second deflecting surface 228 and 258 include multiple planar "wedge surfaces" oriented at different angles relative to the fluid flow. Each of the wedge surfaces of the second deflecting surfaces 228 and 258 may mirror each other in this embodiment to make the leading element 201 largely symmetrical. The second deflecting surface 228 of the first dividing panel 220 defines a first planar surface 228*a* extending adjacent the center of the connecting panel 204 and a second planar surface 228*b* that extends to the right of the first planar surface 228*a* from the first planar surface 228*a* to the first side surface 224. The second planar surface 228*b* can be oriented at a sharper angle to the fluid flow than the first planar surface 228*a*. Likewise, the second deflecting surface 258 of the second dividing panel 250 defines a first planar surface 258*a* extending adjacent the center of the connecting panel 204 and a second planar surface 258*b* that extends to the left of the first planar surface 258*a* from the first planar surface 258*a* to the second side surface 256. Additionally, the second planar surface 258*b* can be oriented at a sharper angle to the fluid flow than the first planar surface 258*a*. It will be understood that the first and second deflecting surfaces 222 and 228 are formed on opposing faces of the first dividing panel 220 along the longitudinal direction 2, specifically in an upper right quadrant of the leading element 201. Likewise, the first and second deflecting surfaces 252 and 258 are formed on opposing faces of the second dividing panel 250 along the longitudinal direction 2, specifically in a lower left quadrant of the leading element 201. The first dividing panel 220, second dividing panel 250, and the connecting panel 204 can be integrally formed as a unitary member, such as by injection molding a plastic material, as understood in the art.

The expansion of the fluid flow above and below the connecting panel 204 occurs as follows. The fluid flow that has been shifted into the upper left quadrant begins to flow along the first planar surface 228*a* of the first dividing panel 220, and then the second planar surface 228*b* of the first dividing panel 220. This movement causes the flow to shift or expand to fill substantially an entire upper portion of the mixing passage 48 defined above the top surface 204*a* of the connecting panel 204. In a similar manner, the fluid flow that has been shifted into the lower right quadrant begins to flow along the first planar surface 258*a* of the second dividing panel 250, and then along the second planar surface 258*b* of the second dividing panel. This movement causes the flow to shift or expand to fill substantially an entire lower portion of the mixing passage 48 defined below the bottom surface 204*b* of the connecting panel 204. The divided flows are then ready to be recombined a trailing edge of the leading element 201, which is defined by a first trailing edge 238 of a first hook section 236 and a second trailing edge 264 of a second hook section 262. This recombination is generally not a complete recombination, as the fluid moving past the first and second trailing edges 238 and 264 is generally already flowing past a leading edge of a mixing element that further defines the fluid flow in a different direction (e.g., the left mixing baffle 202*a*).

Continuing with FIGS. 11A-11D, the left mixing baffle 202*a* will be described. Though left mixing baffle 202*a* is specifically described, the features and elements of left mixing baffle 202*a* can be equally representative of each of the other left mixing baffles 203*a*-210*a*. The left mixing baffle 202*a* includes a dividing panel 304 that is generally planar and oriented in the transverse direction 6. The left mixing baffle 202*a* also includes a mixing panel 306 that is generally planar and oriented in the lateral direction 4. The dividing panel 304 extends along the longitudinal direction 2 and terminates at a leading edge 308, which is defined by first and second hook sections 310 and 312. The first hook section 310 is slightly angled, or "hooked," toward a left side 314 of the dividing panel 304, and the second hook section 312 is slightly angled, or "hooked," toward a right side 316 of the dividing panel 304, where the left side 314 of the dividing panel 304 is opposite the right side 316 along the lateral direction 4. The mixing panel 306 has a shape similar to the dividing panel 304, but includes a trailing edge 320. The trailing edge 320 is defined by a first hook section 324 that is slightly angled toward a top side 328 of the mixing panel 306, as well as a second hook section 326 that is slightly angled toward a bottom side 330 of the mixing panel 306, where the top side 328 of the mixing panel 306 is opposite the bottom side 330 along the transverse direction 6. The various hook sections 310, 312, 324, and 326 help guide the divided fluid flow (which moves along the direction of arrow F in FIGS. 9-10C) to opposite side of the dividing panel 304 and the mixing panel 306, while avoiding a division of flow along a transverse edge which could cause undesirable high amounts of backpressure in the static mixer 10.

The left mixing baffle 202*a* further includes first and second deflecting surfaces 332 and 334 projecting or extending outwardly in opposite directions from the dividing panel 304. The first and second deflecting surfaces 332 and 334 may also be referred to as first and second deflecting panels, respectively. In particular, the first deflecting surface 332 extends from the left side 314 of the dividing panel 304 to a first side 338 of the left mixing baffle 202*a* along the lateral direction 4, and the second deflecting surface 334 extends from the right side 316 of the dividing panel 304 to a second side 340 of the left mixing baffle 202*a* along the lateral direction 4. The first and second sides 338 and 340 of the left mixing baffle 202*a* are configured to engage the inner surface 38 of the mixing conduit 20, as will be described further below. Further, the first and second sides 338 and 340 of the left mixing baffle 202*a* are configured to be completely spaced from an entirety of the first and second sides of the leading element 201 and each of the other mixing baffles 203, due to the mixing element's 200 lack of a continuous sidewall. Each of the first and second deflecting surfaces 332 and 334 includes multiple planar surfaces (also referred to as "wedge surfaces") oriented at different angles relative to the fluid flow through the left mixing baffle 202*a*. For example, the first deflecting surface 332 includes a first planar surface 342 adjacent to the center of the dividing panel 304 and a second planar surface 344 located above the first planar surface 342 along the transverse direction 6. The second planar surface 344 can be oriented at a sharper angle to the fluid flow than the first planar surface 342. In other embodiments, the first and second planar surfaces 342 and 344 may be oriented at the same angle to the fluid flow. Likewise, the second deflecting surface 334 that extends from the right side 316 of the dividing panel 304 includes a first planar surface 346 extending adjacent to the center of the dividing panel 304 and a second planar surface 348 located below the first planar surface 346 along the transverse direction 6. The second planar surface 348 can be oriented at a sharper angle to the fluid flow than the first planar surface 346. In other embodiments, the first and second planar surface 346 and 348 may be oriented at the same angle to the fluid flow.

The fluid flowing through the left mixing baffle 202*a* is directed by these various surfaces as follows. First, the fluid flow encountering the mixing baffle 202*a* is divided by the dividing panel 304 into relatively equal flows, where one flows along the left side 314 of the dividing panel 304, while the other flows along the right side 316 of the dividing panel 304. The first deflecting surface 332 is configured to direct fluid that is flowing along the left side 314 of the dividing panel 304 downwardly toward the lower left quadrant of the left mixing baffle 202*a*, so that fluid travels toward the space adjacent the bottom side 330 of the mixing panel 306. As such, the fluid flow at the top of the left side 314 of the dividing panel 304 is first deflected downwardly by the second planar surface 344 of the first deflecting surface 332. Then, the fluid flow continues to follow along the first planar surface 342 of the first deflecting surface 332 during continued deflection towards the lower left quadrant of the left mixing baffle 202*a*, thus effectively compressing the fluid flow.

The flow on the opposite side of the left mixing baffle 202*a* is similarly diverted using the mirror image structure defined by the second deflecting surface 334 adjacent the right side 316 of the dividing panel 304. In this regard, the second deflecting surface 334 is configured to direct fluid that is flowing along the right side 316 of the dividing panel 304 upwardly toward the upper right quadrant of the left mixing baffle 202*a*, so that fluid travels toward the space adjacent the top side 328 of the mixing panel 306. To this end, the fluid flow at the bottom of the right side 316 of the dividing panel 304 is first deflected upwardly by the second planar surface 348, and then the fluid flow continues to follow along the first planar surface 346 during continued deflection towards the upper right quadrant of the left mixing baffle 202*a*. The "compressed" flow is shown schematically in cross section B (FIG. 10C). Thus, the first half (along a longitudinal or flow direction) of the left-handed mixing baffle 202*a* effectively divides the fluid flow and then shifts each divided portion of the fluid flow in opposite directions to opposing quadrants of the mixing passage 48 when the static mixer 10 is in use in this embodiment.

After being shifted or compressed towards the lower left and upper right quadrants, the fluid flow begins to expand laterally it fill substantially all of the space in the mixing passage 48 once again. To enable this flow expansion, the back half (in the longitudinal direction 2 or flow direction F) of the left mixing baffle 202*a* includes similar structures as those described above for the front half. More particularly, the left mixing baffle 202*a* further includes third and fourth deflecting surfaces 352 and 354 projecting or extending outwardly in opposite directions from the mixing panel 306 towards the top and bottom of the mixing passage 48 (when located in the mixing conduit 20). Specifically, the third deflecting surface 352 extends between the mixing panel 306 and a top surface 366 of the left mixing baffle 202*a*, while the fourth deflecting surface 354 extends between the mixing panel 306 and a bottom surface 368 of the left mixing baffle 202*a*. The top and bottom surfaces 366 and 368 of the left mixing baffle 202*a* are configured to engage the inner surface 38 of the mixing conduit 20, and are spaced from an entirety of the top surfaces of the leading element 201 and the other mixing baffles 203 due to the lack of a continuous sidewall.

Advantageously, each of the third and fourth deflecting surfaces 352 and 354 includes multiple planar "wedge surfaces" oriented at different angles relative to the fluid flow, just like the first and second deflecting surfaces 332 and 334, as described above. Each of the wedge surfaces of the third and fourth deflecting surfaces 352 and 354 can mirror one another in this embodiment to make the left mixing baffle 202*a* largely symmetrical. The third deflecting surface 352 on the top side 328 of the mixing panel 306 includes a first planar surface 356 extending adjacent the center of the mixing panel 306 and a second planar surface 358 located to the left of the first planar surface 356, where the second planar surface 358 can be oriented at a sharper angle to the fluid flow than the first planar surface 356. Likewise, the fourth deflecting surface 354 on the bottom side 330 of the mixing panel 306 includes a first planar surface 360 extending adjacent the center of the mixing panel 306 and a second planar surface 362 located to the right of the first planar surface 360, where the second planar surface 362 is oriented at a sharper angle to the fluid flow than the first planar surface 360. It will be understood that the first and third deflecting surface 332 and 352 are formed on opposing faces of the left mixing baffle 202*a* along the longitudinal direction 2, specifically in an upper left quadrant of the left mixing baffle 202*a*. Likewise, the second and fourth deflecting surfaces 334 and 354 are formed on opposing faces of the left mixing baffle 202*a* along the longitudinal direction 2, specifically in a lower right quadrant of the left mixing baffle 202*a*. The dividing panel 304, the mixing panel 306, and the first, second, third, and fourth deflecting surfaces 332, 334, 352, and 354, can be integrally formed as a unitary member, such as by injection molding a plastic material, as understood in the art.

Thus, the expansion of the fluid flow above and below the mixing panel 306 occurs in a similar manner as the flow shifting or contraction next to the dividing panel 304, but in reverse. The fluid flow that has been shifted into the upper right quadrant begins to flow along the first planar surface 356 of the third deflecting surface 352 and then the second planar surface 358 of the third deflecting surface 352. This movement causes the flow to shift or expand to fill substantially an entire upper portion of the mixing passage 48 defined above the top side 328 of the mixing panel 306. In a similar manner, the fluid flow that has been shifted into the lower left quadrant begins to flow along the first planar surface 360 of the fourth deflecting surface 354 and then along the second planar surface 362 of the fourth deflecting surface 354. This movement causes the flow to shift or expand to fill substantially the entire lower portion of the mixing passage 48 defined by the bottom side 330 of the mixing panel 306. The divided flows are then ready to be recombined at the trailing edge 320 defined by the first and second hook sections 324 and 326 of the mixing panel 306. This recombination is generally not a complete recombination, as the fluid flow moving past the trailing edge 320 of the left mixing baffle 202*a* is generally already flowing past a leading edge on another mixing element that further defines the fluid flow in a different direction (e.g., the right mixing baffle 202*b*).

The shifting and dividing movement of the fluid flow caused by flow around the left-handed mixing baffle 202*a* is capable of doubling the number of layers of two fluids originally presented in layers before entry at the leading edge 308 of the left mixing baffle 202*a*. Of course, it will be understood that the actual flow is likely more mixed together (e.g., the mixing is optimized) as a result of flowing over the differently angled surfaces on the first, second, third, and fourth deflecting surfaces 332, 334, 352, and 354 and as a result of flowing over the various hook sections 310, 312, 324, and 326. In any event, the flow of two or more fluids making up the fluid flow are mixed by flowing through the mixing baffles 203 when inserted into the mixing passage 48 of the mixing conduit 20.

As briefly described above, the right mixing baffle 202*b* shown in FIGS. 12A-12D includes essentially the same identical structure as the left mixing baffle 202*a*, but with the deflecting surfaces oriented as mirror images of those in the left mixing baffle 202*a*. The panels and surfaces of the right-handed mixing baffle are substantially identical in structure and function to the corresponding panels and surfaces described above, so these elements have been labeled with the same reference numbers on the right mixing baffle 202*b*, but with the reference numbers increased by one hundred. Though the features of the right mixing baffle 202*b* are specifically described below, the features and elements of the right mixing baffle 202*b* can be equally representative of the other right mixing baffles 203*b*-210*b*. The right mixing baffle 202*b* includes a dividing panel 404 that is generally planar and oriented in the transverse direction 6. The right mixing baffle 202*b* also includes a mixing panel 406 that is generally planar and oriented in the lateral direction 4. The dividing panel 404 extends along the longitudinal direction 2 and terminates at a leading edge 408, which is defined by first and second hook sections 410 and 412. The first hook section 410 is slightly angled toward a right side 416 of the dividing panel 404, and the second hook section 412 is slightly angled toward a left side 414 of the dividing panel 404, where the left side 414 of the dividing panel 404 is opposite the right side 416 along the lateral direction 4. The mixing panel 406 has a shape similar to the dividing panel 404, but includes a trailing edge 420. The trailing edge 420 is defined by a first hook section 424 that is slightly angled toward a bottom side 430 of the mixing panel 406, as well as a second hook section 426 that is slightly angled toward a top side 428 of the mixing panel 406, where the top side 428 of the mixing panel 406 is opposite the bottom side 430 along the transverse direction 6. The various hook sections 410, 412, 424, and 426 help guide the divided fluid flow (which moves along the direction of arrow F in FIGS. 9-10C) to opposite sides of the dividing panel 404 and the mixing panel 406, while avoiding a division of flow along a transverse edge which could cause undesirable high amounts of backpressure in the static mixer 10.

The right mixing baffle 202*b* further includes first and second deflecting surfaces 432 and 434 that project or extend outwardly in opposite directions from the dividing panel 404. The first and second deflecting surfaces 432 and 434 may also be referred to as first and second deflecting panels, respectively. In particular, the first deflecting surface 432 extends from the left side 414 of the dividing panel 404 to a first side 438 of the right mixing baffle 202*b* along the lateral direction 4, and the second deflecting surface 434 extends from the right side 416 of the dividing panel 404 to a second side 440 of the right mixing baffle 202*b* along the lateral direction 4. The first and second sides 438 and 440 of the right mixing baffle 202*b* are configured to engage the inner surface are configured to engage the inner surface 38 of the mixing conduit 20. Further, the first and second side 438 and 440 of the right mixing baffle 202*b*, due to the lack of a continuous sidewall, are spaced in an entirety from the first and second sides of the leading element 201 and the other mixing baffles 203. Each of the first and second deflecting surfaces 432 and 434 includes multiple planar surfaces (also referred to as "wedge surfaces") oriented at different angles relative to the fluid flow through the right mixing baffle 202*b*. For example, the first deflecting surface 432 includes a first planar surface 442 adjacent to the center of the dividing panel 404 and a second planar surface 444 located below the first planar surface 442 along the transverse direction 6. The second planar surface 444 can be oriented at a sharper angle to the fluid flow than the first planar surface 442. In other embodiments, the first and second planar surface 442 and 444 may be oriented at the same angle to the fluid flow. Likewise, the second deflecting surface 434 that extends from the right side 416 of the dividing panel 404 includes a first planar surface 446 extending adjacent to the center of the dividing panel 404 and a second planar surface 448 located above the first planar surface 446 along the transverse direction 6. The second planar surface 448 can be oriented at a sharper angle to the fluid flow than the first planar surface 446. In other embodiments, the first and second planar surfaces 446 and 448 may be oriented at the same angle to the fluid flow.

The fluid flowing through the right mixing baffle 202*b* is directed by these various surfaces as follows. As noted above, the fluid flowing through the mixing passage 48 has already been divided and recombined by the left mixing baffle 202*a*. Upon reaching the right mixing baffle 202*b*, the fluid flow is divided by the dividing panel 404 into relatively equal flows, where one flows along the left side 414 of the dividing panel 404, while the other flows along the right side 416 of the dividing panel 404. The first deflecting surface 432 is configured to direct fluid that is flowing along the left side 414 of the dividing panel 404 upwardly toward the upper left quadrant of the left mixing baffle 202*a*, so that fluid travels toward the space adjacent the top side 428 of the mixing panel 406. As such, the fluid flow at the top of the left side of the dividing panel 404 is first deflected upwardly by the second planar surface 444 of the first deflecting surface 432. Then, the fluid flow continues to follow along the first planar surface 442 of the first deflecting surface 432 during continued deflection toward the upper left quadrant of the right mixing baffle 202*b*, thus effectively compressing the fluid flow.

The flow on the opposite side of the right mixing baffle 202*b* is similarly diverted using the mirror image structure defined by the second deflecting surface 434 adjacent the right side 416 of the dividing panel 404. In this regard, the second deflecting surface 434 is configured to direct fluid that is flowing along the right side 416 of the dividing panel 404 downwardly toward the lower right quadrant of the right mixing baffle 202*b*, so that fluid flows toward the space adjacent the bottom side 430 of the mixing panel 406. To this end, the fluid flow at the top of the right side 416 of the dividing panel 404 is first deflected downwardly by the second planar surface 448, and then the fluid flow continues to follow along the first planar surface 446 during continued deflection towards the lower right quadrant of the right mixing baffle 202*b*. The "compressed" flow is shown schematically in cross section C (FIG. 10C). Thus, the first half (along a longitudinal or flow direction) of the right mixing baffle 202*b* effectively divides the fluid flow and then shifts each divided portion of the fluid flow in opposite directions to opposing quadrants of the mixing passage 48 when the static mixer 10 is in use in this embodiment.

After being shifted or compressed towards the upper left and lower right quadrants, the fluid flow begins to expand laterally to fill substantially all of the space in the mixing passage 48 once again. To enable this flow expansion, the back half (in the longitudinal direction 2 or flow direction F) of the right mixing baffle 202*b* includes similar structures as those described above for the front half. More particularly, the right mixing baffle 202*b* further includes third and fourth deflecting surfaces 452 and 454 projecting or extending outwardly in opposite directions from the mixing panel 406 towards the top and bottom of the mixing passage 48 (when located in the mixing conduit 20). Specifically, the third deflecting surface 452 extends between the mixing panel 406 and a bottom surface 468 of the right mixing baffle 202*b*, while the fourth deflecting surface 454 extends between the mixing panel 406 and a top surface 466 of the right mixing baffle 202*b*. The top and bottom surfaces 466 and 468 of the right mixing baffle 202*b* are configured to engage the inner surface 38 of the mixing conduit 20. Also, due to the lack of continuous sidewalls, the top and bottom surfaces 466 and 468 are spaced in an entirety from the top and bottom surfaces of the leading element 201 and the other mixing baffles 203.

Advantageously, each of the third and fourth deflecting surfaces 452 and 454 includes multiple planar "wedge surfaces" oriented at different angles relative to the fluid flow, just like the first and second deflecting surfaces 432 and 434, as described above. Each of the wedge surfaces of the third and fourth deflecting surfaces 452 and 454 can mirror one another in this embodiment to make the right mixing baffle 202*b* largely symmetrical. The third deflecting surface 452 on the bottom side 430 of the mixing panel 406 includes a first planar surface 456 adjacent the center of the mixing panel 406 and a second planar surface 458 located to the left of the first planar surface 456, where the second planar surface 458 can be oriented at a sharper angle to the fluid flow than the first planar surface 456. Likewise, the fourth deflecting surface 454 on the top side 428 of the mixing panel 406 includes a first planar surface 460 extending adjacent the center of the mixing panel 406 and a second planar surface 462 located to the right of the first planar surface 460, where the second planar surface 462 is oriented at a sharper angle to the fluid flow than the first planar surface 460. It will be understood that the first and third deflecting surfaces 432 and 452 are formed on opposing faces of the right mixing baffle 202*b* along the longitudinal direction 2, specifically in a lower left quadrant of the right mixing baffle 202*b*. Likewise, the second and fourth deflecting surface 434 and 454 are formed on opposing faces of the right mixing baffle 202*b* along the longitudinal direction 2, specifically in an upper right quadrant of the right mixing baffle 202*b*. The dividing panel 404 and the mixing panel 406, as well as the first, second, third, and fourth deflecting surfaces 432, 434, 452, and 454 can be integrally formed as a unitary member, such as by injection molding a plastic material, as understood in the art.

Thus, the expansion of the fluid flow above and below the mixing panel 406 occurs in a similar manner as the flow shifting or contraction next to the dividing panel 404, but in reverse. The fluid flow that has been shifted into the lower right quadrant begins to flow along the first planar surface 456 of the third deflecting surface 452 and then the second planar surface 458 of the third deflecting surface 452. This movement causes the flow to shift or expand to fill substantially an entire lower portion of the mixing passage 48 defined below the bottom side 430 of the mixing panel 406. In a similar manner, the fluid flow that has been shifted into upper left quadrant begins to flow along the first planar surface 460 of the fourth deflecting surface 454 and then along the second planar surface 462 of the fourth deflecting surface 454. This movement causes the flow to shift or expand to fill substantially the entire upper portion of the mixing passage 48 defined by the top side 428 of the mixing panel 406. The divided flows are then ready to be recombined at the trailing edge 420 defined by the first and second hook sections 424 and 426 of the mixing panel 406. This recombination is generally not a complete recombination, as the fluid flow moving past the trailing edge 420 of the right mixing baffle 202*b* is generally already flowing past a leading edge of another mixing baffle that further defines the fluid flow in a different direction (e.g., the left mixing baffle 203*a*).

The shifting and dividing movement of the fluid flow caused by flow around the right mixing baffle 202*b* is capable of again doubling the number of layers of two fluids originally presented in layers before entry at the leading edge 408 of the right mixing baffle 202*b*. Of course, it will be understood that the actual flow is likely more mixed together (e.g., the mixing is optimized) as a result of flowing over the differently angled surfaces on the first, second, third, and fourth deflecting surfaces 432, 434, 452, and 454 and as a result of flowing over the various hook sections 410, 412, 424, and 426.

Figure 13:
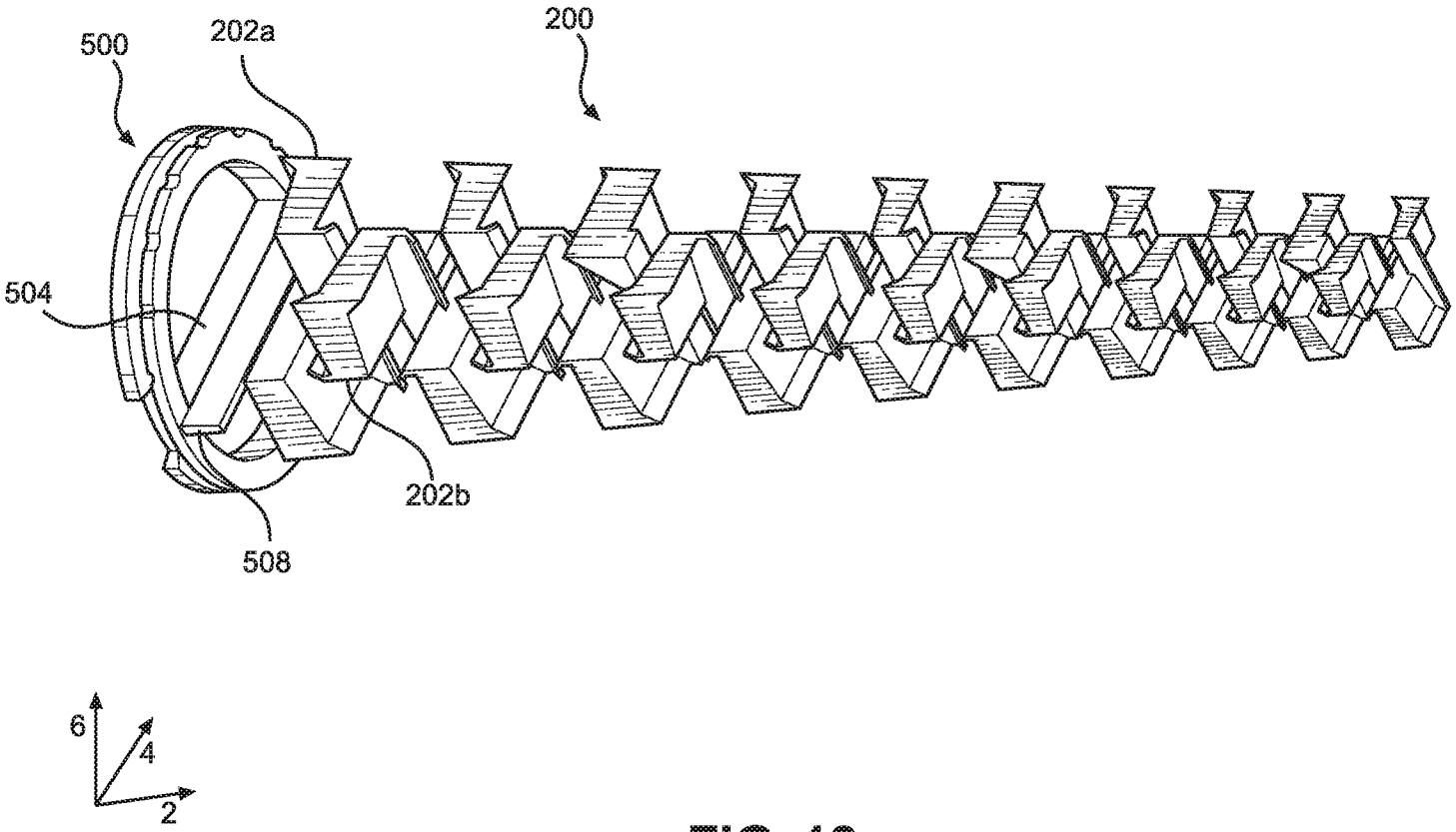
FIG. 13 is a perspective view of a mixing element according to another embodiment of the application.

Turning to FIG. 13, another embodiment of the mixing element 200 will be described. The mixing element 200 may include an integral sealing ring 500 disposed adjacent to the left mixing baffle 202*a*. The integral sealing ring 500 may help define a more complete fluid seal between the mixing element 200 and the mixing conduit 20, such that fluid does not escape out of the mixing conduit 20 during a mixing operation. The integral sealing ring 500 may be integrally connected to the mixing element 200 through first and second bars 504 and 508. However, any method of connecting the integral sealing ring 500 to the mixing element 200 is contemplated. Though the integral sealing ring 500 is described as connecting to the mixing element 200, the integral sealing ring 500 may also be connected to the mixing element 100.

While the invention is described herein using a number of embodiments, these specific embodiments are not intended to limit the scope of the invention as otherwise described and claimed herein. The precise arrangement of elements and order of the steps of articles and methods described herein are not to be considered limiting. For instance, although the steps of the methods are described with reference to sequential series of reference signs and progression of the blocks in the figures, the method can be implemented in a particular order as desired.

What is claimed:

1. A static mixer for mixing a fluid flow having at least two components, the static mixer comprising:

a mixing conduit defining a mixing passage configured to receive the fluid flow; and a mixing element received in the mixing passage and including at least two mixing baffles aligned along a longitudinal direction, wherein no continuous sidewalls extend between the at least two mixing baffles, each of the at least two mixing baffles including:

a first dividing panel defining a top side, a bottom side opposite the top side along a transverse direction that is perpendicular to the longitudinal direction, a first side, a second side opposite the first side along a lateral direction that is perpendicular to the transverse and longitudinal directions, a first width measured from the first side to the second side along the lateral direction at a first location, and a second width measured from the first side to the second side along the lateral direction at a second location that is spaced from the first location along the longitudinal direction, wherein the first width is greater than the second width;

a first deflecting panel extending from the top side of the first dividing panel;

a second dividing panel spaced from the first dividing panel along the transverse direction, the second dividing panel defining a top side and a bottom side opposite the top side along the transverse direction, wherein the top side of the second dividing panel faces the bottom side of the first dividing panel;

a second deflecting panel extending from the bottom side of the second dividing panel;

a third deflecting panel that extends from the bottom side of the first dividing panel to the top side of the second dividing panel;

a first mixing panel extending from the first and second dividing panels along the longitudinal direction; and a second mixing panel extending from the first and second dividing panels along the longitudinal direction, wherein the fluid flow is divided into three flow portions by the first and second dividing panels and the first, second, and third deflecting panels of each of the at least two mixing baffles, and the three flow portions are combined into a mixture upon flowing past the first and second mixing panels of each of the at least two mixing baffles.

2. The static mixer of claim 1, wherein the mixing conduit defines a top inner surface, a bottom inner surface opposite the top inner surface along the transverse direction, a first inner surface, and a second inner surface opposite the first inner surface along the lateral direction, wherein the top inner surface, the bottom inner surface, the first inner surface, and the second inner surface define the mixing passage, wherein the mixing element is positioned in the mixing passage such that the first side of the first dividing panel of each of the at least two mixing baffles contacts the first inner surface of the mixing conduit and the second side of the first dividing panel of each of the at least two mixing baffles contacts the second inner surface of the mixing conduit, the first and second sides of each of the at least two mixing baffles being configured to transfer force imposed on the mixing element by the fluid flow from the mixing element to the mixing conduit.

3. The static mixer of claim 2, wherein the mixing passage defines a first width and a second width, the first and second widths extending from the first inner surface to the second inner surface along the lateral direction, wherein the first width is greater than the second width.

4. The static mixer of claim 2, wherein the first mixing panel of each of the at least two mixing baffles defines a top side and a bottom side opposite the top side along the transverse direction, wherein the top side of the first mixing panel contacts the top inner surface of the mixing conduit and the bottom side of the first mixing panel contacts the bottom inner surface of the mixing conduit, the top and bottom sides of the first mixing panel being configured to transfer force imposed on the mixing element by the fluid flow from the mixing element to the mixing conduit.

5. The mixing baffle of claim 4, wherein the first mixing panel of each of the at least two mixing baffles defines a first height at a third location and a second height at a fourth location from the top side to the bottom side along the transverse direction, wherein the third location is spaced from the fourth location along the longitudinal direction, and the first height is greater than the second height.

6. The static mixer of claim 1, wherein the first mixing panel of each of the at least two mixing baffles is spaced from the second mixing panel along the lateral direction.

7. The static mixer of claim 6, wherein the first and second mixing panels of each of the at least two mixing baffles extend substantially parallel to each other.

8. The static mixer of claim 1, wherein one of the at least two mixing baffles includes a fourth deflecting panel extending from the bottom side of the second dividing panel along the transverse direction.

9. The static mixer of claim 1, wherein one of the at least two mixing baffles includes a fourth deflecting panel that extends from the bottom side of the first dividing panel to the top side of the second dividing panel.

10. The static mixer of claim 1, wherein one of the at least two mixing baffles includes a fourth deflecting panel that extends from the top side of the first dividing panel along the transverse direction.

11. The static mixer of claim 1, wherein the at least two mixing baffles includes a first mixing baffle and a second mixing baffle, and the first and second widths of the first mixing baffle are both greater than the first and second widths of the second mixing baffle.

12. The static mixer of claim 1, wherein the at least two mixing baffles are integral with each other.

13. A static mixer for mixing a fluid flow having at least two components, the static mixer comprising:

a mixing conduit defining a mixing passage configured to receive the fluid flow; and a mixing element received in the mixing passage and including at least two mixing baffles aligned along a longitudinal direction, wherein no continuous sidewalls extend between the at least two mixing baffles, each of the at least two mixing baffles including:

a dividing panel including a first surface and a second surface opposite the first surface along a lateral direction that is perpendicular to the longitudinal direction, a mixing panel connected to the dividing panel and oriented transverse to the dividing panel, the mixing panel including a top side and a bottom side opposite the top side along a transverse direction that is perpendicular to the lateral and longitudinal directions;

a first deflecting panel extending from the first surface of the dividing panel; and a second deflecting panel extending from the second surface of the dividing panel, wherein each of the at least two mixing baffles defines a first width measured at a first location along the lateral direction that extends from a first side that extends from the mixing panel along the transverse direction to a second side that extends from the mixing panel along the transverse direction, and a second width measured from the first side to the second side along the lateral direction at a second location that is spaced from the first location along the longitudinal direction, wherein the first width is greater than the second width, wherein the fluid flow is divided into two flow portions by the dividing panel and the first and second deflecting panels of each of the at least two mixing baffles, and the two flow portions are combined into a mixture upon flowing past the mixing panel of each of the at least two mixing baffles.

14. The static mixer of claim 13, wherein the mixing conduit defines a top inner surface, a bottom inner surface opposite the top inner surface along the transverse direction, a first inner surface, and a second inner surface opposite the first inner surface along the lateral direction, wherein the top inner surface, the bottom inner surface, the first inner surface, and the second inner surface define the mixing passage, wherein the mixing element is positioned in the mixing passage such that the first side of each of the at least two mixing baffles contacts the first inner surface of the mixing conduit and the second side of each of the at least two mixing baffles contacts the second inner surface of the mixing conduit, the first and second sides of each of the at least two mixing baffles being configured to transfer force imposed on the mixing element by the fluid flow from the mixing element to the mixing conduit.

15. The static mixer of claim 14, wherein the mixing conduit defines first and second inner widths that extend from the first inner surface to the second inner surface along the lateral direction, wherein the first inner width is greater than the second inner width.

16. The static mixer of claim 14, wherein each of the at least two mixing baffles defines a top surface extending from the dividing panel along the lateral direction, a bottom surface opposite the top surface and extending from the dividing panel along the lateral direction, a first height measured from the top surface to the bottom surface along the transverse direction at a third location, and a second height measured from the top surface to the bottom surface along the transverse direction at a fourth location spaced from the third location along the longitudinal direction, wherein the first height is greater than the second height.

17. The static mixer of claim 16, wherein the at least two mixing baffles includes a left mixing baffle and a right mixing baffle, and the first and second heights of the left mixing baffle are greater than the first and second heights of the right mixing baffle.

18. The static mixer of claim 16, wherein the mixing element is positioned in the mixing passage such that the top surface of each of the at least two mixing baffles contacts the top inner surface of the mixing conduit and the bottom surface of each of the at least two mixing baffles contacts the bottom inner surface of the mixing conduit, the top and bottom surfaces of each of the at least two mixing baffles being configured to transfer force imposed on the mixing element by the fluid flow from the mixing element to the mixing conduit.

19. The static mixer of claim 13, wherein the at least two mixing baffles includes a left mixing baffle and a right mixing baffle, and the first and second widths of the left mixing baffle are greater than the first and second widths of the right mixing baffle.

20. The static mixer of claim 13, wherein the at least two mixing baffles includes a left mixing baffle and a right mixing baffle, wherein the left mixing baffle comprises a third deflecting surface projecting from the top side of the mixing panel, the third deflecting surface being spaced from the first deflecting surface along the longitudinal direction.

21. The static mixer of claim 20, wherein the left mixing baffle comprises a fourth deflecting surface projecting from the bottom side of the mixing panel, the fourth deflecting surface being spaced from the second deflecting surface along the longitudinal direction.

22. The mixing element of claim 21, wherein the right mixing baffle comprises a third deflecting surface projecting from the bottom side of the mixing panel, the third deflecting surface being spaced from the first deflecting surface along the longitudinal direction.

23. The mixing element of claim 22, wherein the right mixing baffle comprises a fourth deflecting surface projecting from the top side of the mixing panel, the fourth deflecting surface being spaced from the second deflecting surface along the longitudinal direction.

24. The mixing element of claim 23, wherein the dividing panel of the right mixing baffle is integral with the mixing panel of the left mixing baffle.

25. A static mixer for mixing a fluid flow having at least two components, the static mixer comprising:

a mixing conduit defining an inner surface and a mixing passage defined by the inner surface that is configured to receive the fluid flow; and a mixing element that is tapered along a longitudinal direction and is received in the mixing passage, the mixing element including at least two mixing baffles aligned along the longitudinal direction, wherein no continuous sidewalls extend between the at least two mixing baffles, each of the at least two mixing baffles including:

at least one dividing panel;

at least two deflecting panels extending from the at least one dividing panel, wherein the at least two deflecting panels and the at least one dividing panel are configured to divide the flow into at least two flow portions; and at least one mixing panel connected to the at least one dividing panel, wherein the at least two flow portions are combined into a mixture upon flowing past the at least one mixing panel, wherein the mixing element is configured to bias against the inner surface of the mixing conduit such that force imposed on the mixing element by the fluid flow is transferred from the mixing element to the mixing conduit.

26. The static mixer of claim 25, wherein the mixing element defines a monolithic body such that the at least two mixing baffles are integral with each other.

27. The static mixer of claim 25, wherein the at least one dividing panel includes first and second dividing panels, the at least two deflecting panels includes first, second, third, and fourth deflecting panels, and the at least one mixing panel includes first and second mixing panels.

28. The static mixer of claim 27, wherein the first and second dividing panels are spaced apart along a transverse direction that is perpendicular to the longitudinal direction, and the first and second mixing panels are spaced apart along the a lateral direction that is perpendicular to the longitudinal and transverse directions.

29. The static mixer of claim 27, wherein the at least two flow portions includes first, second, and third flow portions.

30. The static mixer of claim 25, wherein the at least one dividing panel includes a single dividing panel, the at least two deflecting panels includes first and second deflecting panels, and the at least one mixing panel includes a single mixing panel.

31. The static mixer of claim 30, wherein the at least two flow portions includes first and second flow portions.

* * * * *